US010968857B2

(12) United States Patent
Benson et al.

(10) Patent No.: US 10,968,857 B2
(45) Date of Patent: Apr. 6, 2021

(54) FUEL PUMP PRESSURE CONTROL STRUCTURE AND METHODOLOGY

(71) Applicant: Cummins Inc., Columbus, IN (US)

(72) Inventors: Donald J. Benson, Columbus, IN (US); Paul Peavler, Columbus, IN (US)

(73) Assignee: Cummins Inc., Columbus, IN (US)

( * ) Notice: Subject to any disclaimer, the term of this patent is extended or adjusted under 35 U.S.C. 154(b) by 58 days.

(21) Appl. No.: 16/344,764

(22) PCT Filed: Oct. 24, 2017

(86) PCT No.: PCT/US2017/058078
§ 371 (c)(1),
(2) Date: Apr. 24, 2019

(87) PCT Pub. No.: WO2018/081115
PCT Pub. Date: May 3, 2018

(65) Prior Publication Data

US 2019/0331053 A1 Oct. 31, 2019

Related U.S. Application Data

(60) Provisional application No. 62/411,943, filed on Oct. 24, 2016.

(51) Int. Cl.
*F02M 63/00* (2006.01)
*F02D 41/38* (2006.01)
(Continued)

(52) U.S. Cl.
CPC ..... *F02D 41/38* (2013.01); *F02M 59/08* (2013.01); *F02D 2200/0602* (2013.01);
(Continued)

(58) Field of Classification Search
CPC .... F02M 59/08; F02M 63/0225; F02D 41/38; F02D 2200/0602; F02D 2250/04; F02D 2250/31
See application file for complete search history.

(56) References Cited

U.S. PATENT DOCUMENTS 4,777,921 A * 10/1988 Miyaki ..... F02D 41/3827 123/456
5,094,216 A 3/1992 Miyaki et al.
(Continued)

FOREIGN PATENT DOCUMENTS

EP 0501459 A2 9/1992
EP 1241349 A2 9/2002
EP 2719887 A1 4/2014

OTHER PUBLICATIONS

International Search Report and Written Opinion issued by the ISA/US, Commissioner for Patents, dated Jan. 4, 2018, for International Application No. PCT/US2017/058078; 13 pages.
(Continued)

*Primary Examiner* — Thomas N Moulis
(74) *Attorney, Agent, or Firm* — Faegre Drinker Biddle & Reath LLP

(57) ABSTRACT

A method and system is provided of controlling a pump having a pumping element configured to provide pressurized fuel to a common rail accumulator coupled to a plurality of fuel injectors configured to inject fuel into a corresponding plurality of cylinders of an engine, comprising: receiving rail pressure values indicating a current fuel pressure in the accumulator; and responding to the received at least one rail pressure value by controlling operation of the pumping element during each potential pumping event of the pumping element to generate actual pumping events during at least some of the potential pumping events to cause the rail pressure values to remain within a desired range and to at
(Continued)

least one of increase an overall efficiency of the pump, decrease audible noise generated by the pump, increase reliability of the pump and reduce injection pressure variations at the plurality of fuel injectors.

21 Claims, 34 Drawing Sheets

(51) Int. Cl.
*F02M 59/08* (2006.01)
*F02M 63/02* (2006.01)

(52) U.S. Cl.
CPC ..... *F02D 2250/04* (2013.01); *F02D 2250/31* (2013.01); *F02M 63/0225* (2013.01)

(56) References Cited

U.S. PATENT DOCUMENTS 5,201,294 A * 4/1993 Osuka ..... F02D 41/221 123/198 D
5,404,855 A * 4/1995 Yen ..... F02M 41/16 123/446
6,016,791 A * 1/2000 Thomas ..... F02D 41/3845 123/456
6,192,864 B1 * 2/2001 Nishimura ..... F02D 41/3845 123/456
6,343,588 B1 2/2002 Onishi et al.
6,701,898 B2 * 3/2004 Tokuo ..... F02D 41/38 123/456
6,725,837 B2 * 4/2004 Hiraku ..... F02D 41/3836 123/436
7,063,073 B2 * 6/2006 Ausiello ..... F02M 59/265 123/446
7,073,487 B1 7/2006 Oono
7,198,034 B2 * 4/2007 Ausiello ..... F02M 59/265 123/506
7,392,790 B2 * 7/2008 Shafer ..... F02D 41/22 123/198 D
7,406,949 B2 8/2008 Puckett
7,490,592 B2 * 2/2009 Kaneko ..... F02D 41/221 123/506
7,559,313 B2 7/2009 Tokuo
7,568,469 B2 * 8/2009 Tokuo ..... F02M 59/367 123/497
7,823,566 B2 11/2010 Fox et al.
8,015,964 B2 9/2011 Eddy
8,136,508 B2 3/2012 Eddy
8,516,995 B2 8/2013 Sinclair
9,309,849 B2 4/2016 Tanabe et al.
2002/0033167 A1 * 3/2002 Hiraku ..... F04B 49/243 123/456
2004/0154594 A1 8/2004 Miyashita
2006/0021598 A1 2/2006 Nomura
2006/0118089 A1 * 6/2006 Tokuo ..... F02D 41/3845 123/458
2007/0079809 A1 4/2007 Oono
2008/0127942 A1 6/2008 Kaneko

OTHER PUBLICATIONS

International Preliminary Report on Patentability issued by the IPEA/US, Commissioner for Patents, dated Feb. 5, 2019, for International Application No. PCT/US2017/058078; 11 pages.

* cited by examiner

| FIG. | Pumping Hardware Configuration / Ratio of potential pumping events to the injection frequency | Can the desired pressure level be achieved at the operating conditions when pumping only on pumping plungers which coincides with injection? | Can the desired pressure level be achieved at the operating conditions when pumping only on a single pumping plunger? | Possible number of pumping plungers which can be commanded to pump at this operating condition | Does the control system prefer full digital pumping events? | Is the pumping command always digital (full or zero) at this operating condition? | Is the pumping command digital (full or zero) for the plunger which coincides with injection? | Does the control system prefer pumping to coincide with injection? | Is pumping commanded only for pumping plungers which coincide with injection? |
|---|---|---|---|---|---|---|---|---|---|
| 3 | 2X | Yes or No | Yes and No | All | No | No | No | No | No |
| 4 | 2X | Yes or No | Yes and No | All | Yes | Yes | Yes | No | No |
| 5 | 2X | Yes | Yes | One | Yes | Yes | Yes | Yes | Yes |
| 6 | 2X | Yes | Yes | One | No | No | No | Yes | Yes |
| 7 | 2X | No | No | All | Yes | Yes | Yes | Yes | No |
| 8 | 2X | No | No | All | Yes | No | Yes | Yes | No |
| 9 | 2X | Yes or No | Yes and No | All | No | No | No | No | No |
| 10 | 2X | Yes | No | One | No | No | No | Yes | Yes |
| 11 | 2X | Yes or No | Yes and No | All | No | No | No | No | No |
| 12 | 2X | Yes | No | One | No | No | No | No | Yes |
| 13 | 1X | Yes | Yes and No | All | No | No | No | Yes | Yes |
| 14 | 1X | Yes | Yes and No | All | Yes | Yes | Yes | Yes | Yes |
| 15 | 1X | Yes | No | All | Yes | No | No | Yes | Yes |
| 16 | 1X | Yes | Yes and No | All | No | No | No | Yes | Yes |
| 17 | Non-Synchronous | Yes or No | Yes and No | All | No | No | No | No | No |
| 18 | Non-Synchronous | Yes or No | Yes and No | All | Yes | Yes | Yes | No | No |
| 19 | Non-Synchronous | Yes or No | Yes | One | Yes | Yes | No | No | No |
| 20 | Non-Synchronous | Yes or No | Yes and No | All | Yes | Yes | Yes | Yes | Yes |
| 21 | Non-Synchronous | No | No | All | Yes | Yes | Yes | Yes | No |
| 22 | Non-Synchronous | No | No | All | Yes | No | Yes | Yes | No |
| 23 | Non-Synchronous | Yes | Yes and No | All | No | No | No | Yes | Yes |
| 24 | Non-Synchronous | Yes or No | Yes and No | All | No | No | No | No | No |
| 25 | Non-Synchronous | Yes or No | Yes and No | All | No | No | No | No | No |
| 26 | Non-Synchronous | Yes or No | Yes and No | All | No | No | No | Yes | Yes |
| 27 | Non-Synchronous | Yes | Yes | One | No | No | No | No | No |

FIG. 2B

| FIG. | Pumping Hardware Configuration / Ratio of potential pumping events to the injection frequency | Can the desired pressure level be achieved at the operating conditions when pumping only on pumping plungers which coincides with injection? | Can the desired pressure level be achieved at the operating conditions when pumping only on a single pumping plunger? | Possible number of pumping plungers which can be commanded to pump at this operating condition. | Does the control system prefer full digital pumping events? | Is the pumping command always digital [full or zero] at this operating condition? | Is the pumping command digital [full or zero] for the plunger which coincides with injection? | Does the control system prefer pumping to coincide with injection? | Is pumping commanded only for pumping plungers which coincide with injection? |
|---|---|---|---|---|---|---|---|---|---|
| 28 | Non-Synchronous | Yes | Yes | All | No | No | No | No | No |
| 29 | Non-Synchronous | Yes | Yes | All | No | No | No | No | No |
| 30 | Non-Synchronous | Yes | Yes | All | No | No | No | No | No |
| 31 | 2X | Yes | Yes | All | No | No | No | No | No |

FIG. 2C

FUEL PUMP PRESSURE CONTROL STRUCTURE AND METHODOLOGY

RELATED APPLICATIONS

The present application is a national phase filing of PCT International Application Serial No. PCT/US2017/058078, filed Oct. 24, 2017, which is related to and claims priority to U.S. Provisional Application Ser. No. 62/411,943, filed on Oct. 24, 2016 and titled "FUEL PUMP PRESSURE CONTROL STRUCTURE AND METHODOLOGY," the entire disclosures of which being hereby expressly incorporated herein by reference.

TECHNICAL FIELD

The present invention relates generally to fuel pumps and more particularly to fuel pump operational control methodologies.

BACKGROUND

Fueling systems, and in particular fueling systems using a common rail accumulator, are typically controlled to maintain the fuel available to the fuel injectors within a desired pressure range. To this end, conventional control methodologies for fuel pumps receive feedback representing the rail pressure and cause the pumping element(s) of the fuel pump to deliver a partial capacity quantity of fuel to the accumulator during every pumping cycle. However, fuel pumps are inherently inefficient when operated at less than full capacity. Moreover, in many system configurations a percentage of pumping cycles are not in the preferred phasing relationship with the operation of the fuel injectors. Therefore, causing fuel delivery during every pumping cycle may result in increased audible noise, vibration and harshness. Also, controlling pump operation to rail pressure alone may include operating the pumping element(s) in regions that impair reliability and durability and/or cause undesirable variability in rail pressure at or during fuel injection events. Accordingly, it is desirable to provide control methodologies for fueling systems that address these and other shortcomings of conventional approaches.

SUMMARY

According to one embodiment, the present disclosure provides a method of controlling a pump having at least one pumping element configured to provide pressurized fuel to a common rail accumulator coupled to a plurality of fuel injectors configured to inject fuel into a corresponding plurality of cylinders of an engine, comprising: receiving rail pressure values indicating a current fuel pressure in the accumulator; and responding to the received at least one rail pressure value by controlling operation of the at least one pumping element during each potential pumping event of the at least one pumping element to generate actual pumping events during at least some of the potential pumping events to cause the rail pressure values to remain within a desired range or achieve a desired pressure valve and to at least one of increase an overall efficiency of the pump, decrease audible noise generated by the pump or engine, increase reliability of the pump and reduce injection pressure variations at the plurality of fuel injectors. In one aspect of this embodiment, the at least one pumping element comprises two pumping elements. In a variant of this aspect, the two pumping elements are configured to have one of a 1×, 1.5× or 2× ratio of potential pumping events to injection events by the plurality of fuel injectors. In another variant, responding to the received at least one rail pressure value by controlling operation of the at least one pumping element comprises generating actual pumping events of either 100% fuel delivery or 0% fuel delivery during each of the potential pumping events to increase the overall efficiency of the pump. In another variant, responding to the received at least one rail pressure value by controlling operation of the at least one pumping element comprises generating actual pumping events of either 100% fuel delivery or 0% fuel delivery during each of the potential pumping events of one of the pumping elements which is at a preferred phasing relative to the injection events and generating actual pumping events of 0% fuel delivery during all of the potential pumping events of another of the pumping elements which is not at a preferred phasing relative to the injection events, thereby decreasing audible noise generated by the pump or engine. In yet another variant, responding to the received at least one rail pressure value by controlling operation of the at least one pumping element comprises generating actual pumping events of greater than 0% but less than 100% fuel delivery during each of the potential pumping events of one of the pumping elements which is at a preferred phasing relative to the injection events and generating actual pumping events of 0% fuel delivery during each of the potential pumping events of another of the pumping elements which is not at a preferred phasing relative to the injection events, thereby decreasing audible noise generated by the pump or engine. In still another variant, responding to the received at least one rail pressure value by controlling operation of the at least one pumping element comprises generating actual pumping events of 100% fuel delivery during each of the potential pumping events of one of the pumping elements which is at a preferred phasing relative to the injection events and generating actual pumping events of either 100% fuel delivery or 0% fuel delivery during the potential pumping events of another of the pumping elements which is not at a preferred phasing relative to the injection events, thereby increasing the overall efficiency of the pump and decreasing audible noise of the pump or engine. In another variant, responding to the received at least one rail pressure value by controlling operation of the at least one pumping element comprises generating actual pumping events of 100% fuel delivery during each of the potential pumping events of one of the pumping elements which is at a preferred phasing relative to the injection events and generating actual pumping events of greater than 0% but less than 100% fuel delivery during each of the potential pumping events of another of the pumping elements which is not at a preferred phasing relative to the injection events. In another variant, responding to the received at least one rail pressure value by controlling operation of the at least one pumping element comprises generating actual pumping events to deliver an amount of fuel that is greater than an undesirable fuel delivery percentage during half of the potential pumping events of one of the pumping elements which is at a preferred phasing relative to the injection events, generating actual pumping events to deliver an amount of fuel that is less than the undesirable fuel delivery percentage during another half of the potential pumping events of the one of the pumping elements which is at a preferred phasing relative to the injection events and generating actual pumping events of 0% fuel delivery during each of the potential pumping events of another of the pumping elements which is not at a preferred phasing relative to the injection events, thereby improving the reliability of the pump. In yet another variant, responding to the received at least one rail pressure value by controlling operation of the at least one pumping element comprises generating actual pumping events to deliver either 0% fuel delivery or an amount of fuel that is greater than an undesirable fuel delivery percentage during each of the potential pumping events of one of the pumping elements which is at a preferred phasing relative to the injection events and during each of the potential pumping events of another of the pumping elements which is not at a preferred phasing relative to the injection events. In still another variant, responding to the received at least one rail pressure value by controlling operation of the at least one pumping element comprises generating actual pumping events to deliver either 0% fuel delivery or an amount of fuel that is greater than an undesirable fuel delivery percentage during each of the potential pumping events of one of the pumping elements which is at a preferred phasing relative to the injection events and generating actual pumping events of 0% fuel delivery during each of the potential pumping events of another of the pumping elements which is not at a preferred phasing relative to the injection events. In another variant, responding to the received at least one rail pressure value by controlling operation of the at least one pumping element comprises generating actual pumping events of 100% fuel delivery during each of the potential pumping events of one of the pumping elements and generating actual pumping events of greater than 0% but less than 100% fuel delivery during each of the potential pumping events of another of the pumping elements. In another variant, responding to the received at least one rail pressure value by controlling operation of the at least one pumping element comprises generating actual pumping events to deliver an amount of fuel that is greater than an undesirable fuel delivery percentage during each of the potential pumping events of one of the pumping elements and generating actual pumping events to deliver an amount of fuel that is less than the undesirable fuel delivery percentage during each of the potential pumping events of another of the pumping elements, thereby improving the reliability of the pump. In yet another variant, responding to the received at least one rail pressure value by controlling operation of the at least one pumping element comprises generating actual pumping events of either 100% fuel delivery or 0% fuel delivery during each of the potential pumping events of one of the pumping elements and generating actual pumping events of 0% fuel delivery during each of the potential pumping events of another of the pumping elements. In a further feature of this variant, the actual pumping events of 100% fuel delivery are at a preferred phasing relative to the injection events, thereby decreasing audible noise of the pump or engine. In another variant, responding to the received at least one rail pressure value by controlling operation of the at least one pumping element comprises generating actual pumping events of 100% fuel delivery during each of the potential pumping events of one of the pumping elements which are at a preferred phasing relative to the injection events, generating actual pumping events of greater than 0% but less than 100% fuel delivery during each of the potential pumping events of the one of the pumping elements which are not at a preferred phasing relative to the injection events, and generating actual pumping events of 0% fuel delivery during each of the potential pumping events of another of the pumping elements. In yet another variant, responding to the received at least one rail pressure value by controlling operation of the at least one pumping element comprises generating actual pumping events to deliver an amount of fuel that is either less than or greater than an undesirable fuel delivery percentage during each of the potential pumping events of one of the pumping elements which are at a preferred phasing relative to the injection events and generating actual pumping events of 0% fuel delivery during each of the potential pumping events of the one of the pumping elements which are not at a preferred phasing relative to the injection events and during each of the potential pumping events of another of the pumping elements. In still another variant, responding to the received at least one rail pressure value by controlling operation of the at least one pumping element comprises generating actual pumping events during each of the potential pumping events to deliver an amount of fuel to the accumulator to cause rail pressure to be substantially the same at a start of each injection event. In another variant, responding to the received at least one rail pressure value by controlling operation of the at least one pumping element comprises generating actual pumping events during each of the potential pumping events to deliver an amount of fuel to the accumulator to cause rail pressure to be substantially the same during each injection event.

Another embodiment of the present disclosure provides a method of controlling a fuel pump having a plurality of pumping elements, comprising: determining at least one of a desired rail pressure range or a desired rail pressure value; determining a quantity of fuel to deliver during each potential pumping event corresponding to the plurality of pumping elements to at least one of maintain the rail pressure within the desired rail pressure range or near the desired rail pressure value and to increase pump efficiency, decrease audible noise generated by the pump, improve pump reliability, or reduce variation of rail pressure during fuel injection events; and generating actual pumping events to deliver the determined quantity of fuel during each potential pumping event. In one aspect of this embodiment, generating actual pumping events comprises generating actual pumping events of either 100% fuel delivery or 0% fuel delivery to improve pump reliability. In another aspect, generating actual pumping events comprises generating actual pumping events during potential pumping events that are at a preferred phasing relative to injection events to decrease pump audible noise. In yet another aspect, generating actual pumping events comprises generating actual pumping events to deliver an amount of fuel that is greater than or less than an undesirable fuel delivery percentage to improve pump reliability. In still another aspect, generating actual pumping events comprises generating actual pumping events to deliver an amount of fuel to cause rail pressure to be substantially the same at a start or during each injection event.

In another embodiment of the present disclosure, a fueling system is provided, comprising: a fuel pump comprises a plurality of pumping elements; an accumulator coupled to the fuel pump; a pressure sensor coupled to the accumulator, the pressure sensor configured to output rail pressure values; a plurality of fuel injectors coupled to the accumulator to receive pressurized fuel for delivery to an engine during injection events; and a controller coupled to the fuel pump, the pressure sensor and the plurality of fuel injectors, the controller being configured to determine a desired range of rail pressure values, determine a quantity of fuel to deliver during each potential pumping event corresponding to the plurality of pumping elements to maintain the rail pressure values within the desired range and to increase fuel pump efficiency, decrease audible noise generated by the fuel pump, improve fuel pump reliability, or reduce variation of rail pressure values during fuel injection events, and generate actual pumping events to deliver the determined quantity of fuel during each potential pumping event.

While multiple embodiments are disclosed, still other embodiments of the present invention will become apparent to those skilled in the art from the following detailed description, which shows and describes illustrative embodiments of the invention. Accordingly, the drawings and detailed description are to be regarded as illustrative in nature and not restrictive.

BRIEF DESCRIPTION OF THE DRAWINGS

The above-mentioned and other features of this disclosure and the manner of obtaining them will become more apparent and the disclosure itself will be better understood by reference to the following description of embodiments of the present disclosure taken in conjunction with the accompanying drawings, wherein:

FIGS. 2B-2C are a table providing an overview of characteristics of the systems and control methodologies depicted in FIGS. 3-31.

Figure 1A:
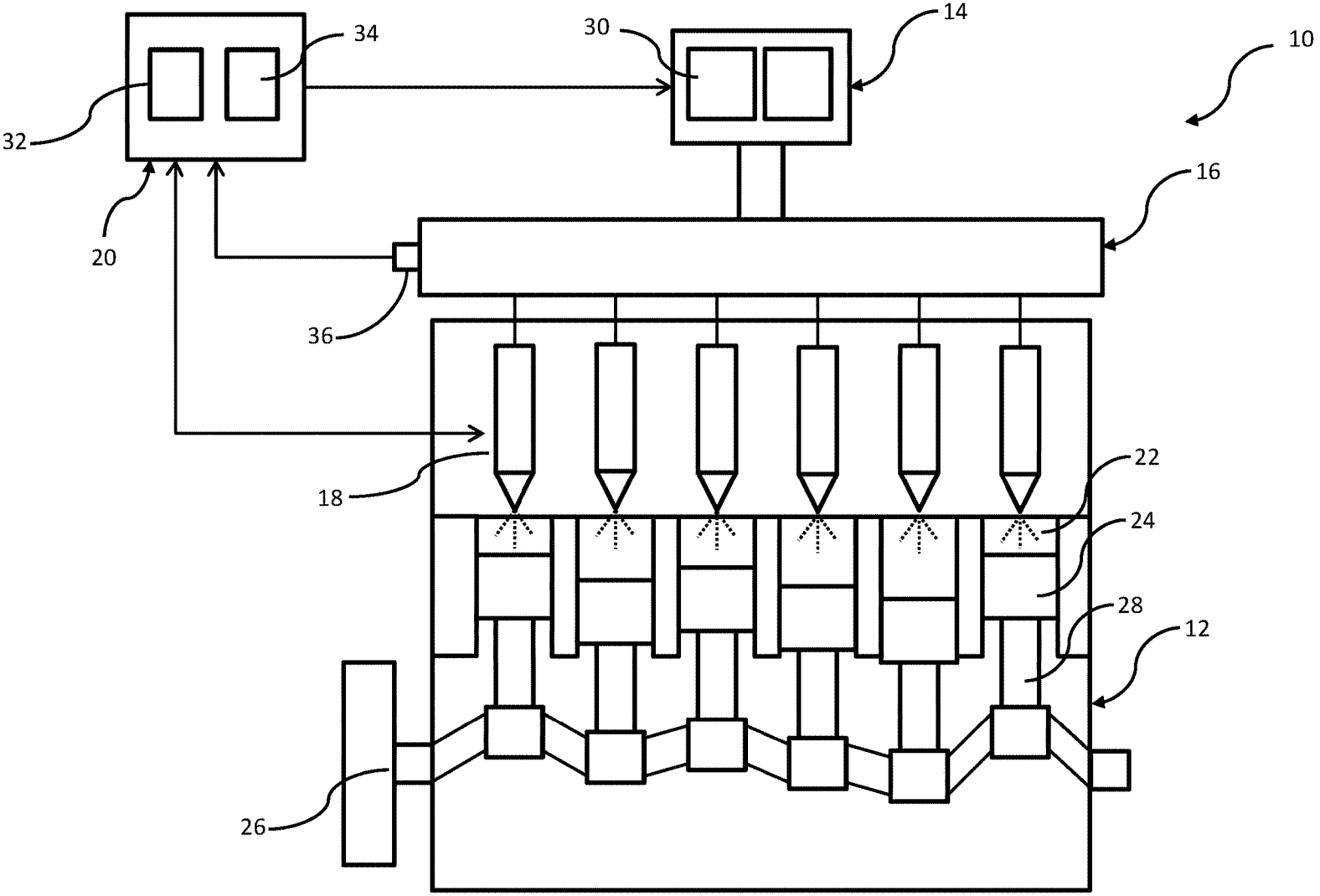
FIG. 1A is a conceptual drawing of a fueling system and an engine.

While the present disclosure is amenable to various modifications and alternative forms, specific embodiments have been shown by way of example in the drawings and are described in detail below. The present disclosure, however, is not to limit the particular embodiments described. On the contrary, the present disclosure is intended to cover all modifications, equivalents, and alternatives falling within the scope of the appended claims.

DETAILED DESCRIPTION

One of ordinary skill in the art will realize that the embodiments provided can be implemented in hardware, software, firmware, and/or a combination thereof. For example, the controllers disclosed herein may form a portion of a processing subsystem including one or more computing devices having memory, processing, and communication hardware. The controllers may be a single device or a distributed device, and the functions of the controllers may be performed by hardware and/or as computer instructions on a non-transient computer readable storage medium. For example, the computer instructions or programming code in the controller (e.g., an electronic control module ("ECM")) may be implemented in any viable programming language such as C, C++, HTML, XTML, JAVA or any other viable high-level programming language, or a combination of a high-level programming language and a lower level programming language.

As used herein, the modifier "about" used in connection with a quantity is inclusive of the stated value and has the meaning dictated by the context (for example, it includes at least the degree of error associated with the measurement of the particular quantity). When used in the context of a range, the modifier "about" should also be considered as disclosing the range defined by the absolute values of the two endpoints. For example, the range "from about 2 to about 4" also discloses the range "from 2 to 4."

Referring now to FIG. 1A, portions of a fueling system 10 and an engine 12 are shown. Fueling system 10 generally includes a fuel pump 14, a common rail fuel accumulator 16, a plurality of fuel injectors 18 and a controller 20. Engine 12 generally includes a plurality of cylinders 22 in which a plurality of pistons 24 reciprocate under power provided by fuel combustion, thereby causing a crankshaft 26 to rotate via a corresponding plurality of connecting rods 28. Fuel pump 14, which is depicted in this example as having two pumping elements 30 (further described below), receives fuel from a fuel source (not shown), pressurizes the fuel, and provides the pressurized fuel to accumulator 16. Fuel injectors 18, which are coupled to and receive fuel from accumulator 16 under control of controller 20, deliver fuel (also under control of controller 20) to cylinders 22 at specified times during the engine cycle as is well known in the art.

The highly simplified controller 20 shown in FIG. 1A includes a processor 32 and a memory 34. Of course, controller 20 is substantially more complex and may include multiple processors and memory devices as well as a plurality of other electronic components. In this example, controller 20 receives pressure measurements from a pressure sensor 36 coupled to accumulator 16. The pressure measurements indicate the pressure of fuel in accumulator 16. Controller 20 controls operation of pump 14 in response to the pressure measurements in the manner described herein. More specifically, controller 20 independently controls the delivered pumping quantity output of each potential high pressure pumping event of each pumping element 30. As is further described below, the ability to control the individual pumping event delivery quantities permits controller 20 to operate pump 14 in different control modes based on the instantaneous operational state of the pump and the system to improve performance with respect to desired outputs such as fuel economy and efficiency, audible noise, pump drive system stresses, pump durability and reliability, and pressure variation.

Figure 1B:
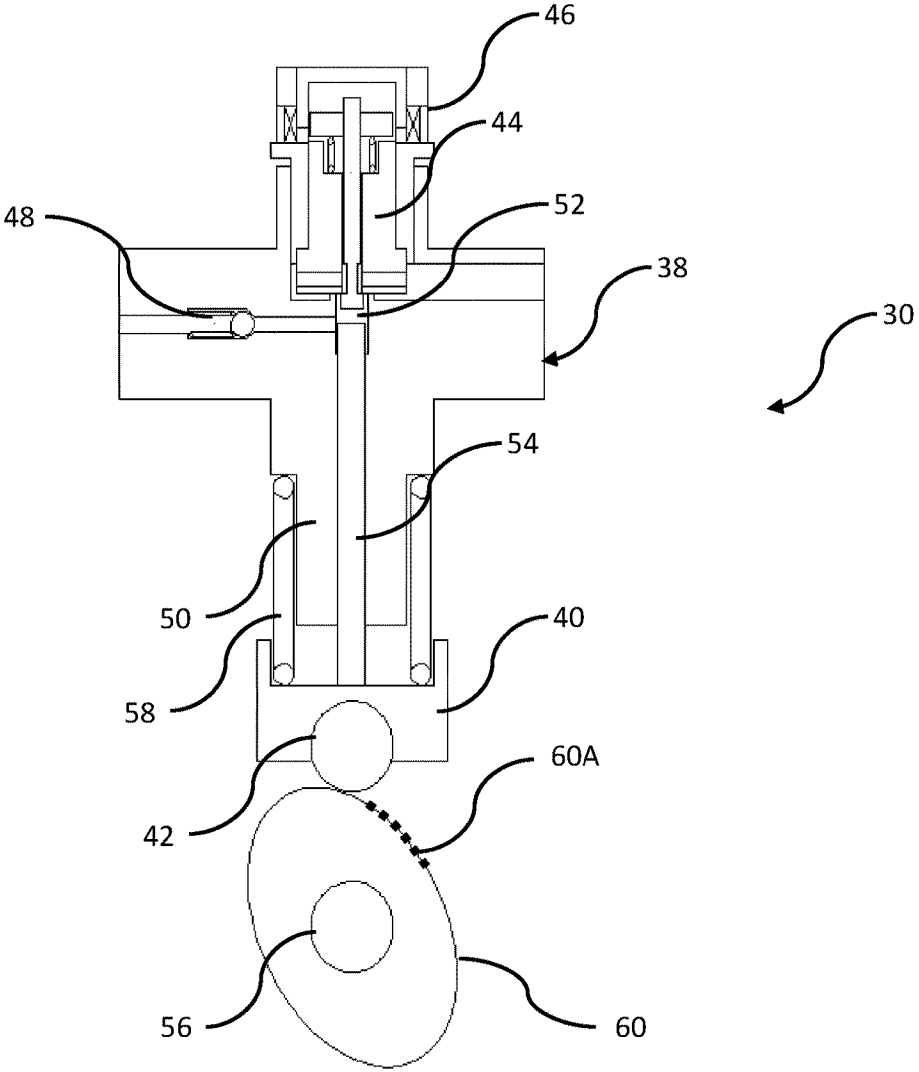
FIG. 1B is a cross-sectional side view of a pumping element of the fueling system of FIG. 1A.

FIG. 1B depicts one example of a pumping element 30 of FIG. 1A in greater detail. As shown, pumping element 30 generally includes a housing 38, a tappet 40 and a roller 42. An inlet valve 44 controlled by a solenoid 46 is disposed at an upper end of housing 38. An outlet valve 48 is also disposed in housing 38. Housing 38 includes a barrel 50 which defines a pumping chamber 52. A plunger 54 coupled to tappet 40 reciprocates in pumping chamber 52, compressing any fuel in pumping chamber 52 during upward pumping strokes for delivery to outlet valve 48, and from there, to accumulator 16. Fuel is delivered to pumping chamber 52 by inlet valve 44 during downward filling strokes.

Reciprocal motion of plunger 54 is powered by rotational motion of camshaft 56 (which is coupled to crankshaft 26 of FIG. 1A) and a downward biasing force of return spring 58. As camshaft 56 rotates, an eccentric lobe 60 mounted to camshaft 56 also rotates. Roller 42 remains in contact with lobe 60 as a result of the biasing force of spring 58. Accordingly, during half of a revolution of camshaft 56, lobe 60 pushes roller 42 (and tappet 40 and plunger 54) upwardly, and during the other half spring 58 pushes roller 42 (and tappet 40 and plunger 54) downwardly into contact with lobe 60. The operation of inlet valve 44 and outlet valve 48 is controlled by controller 20 to cause pumping element 30 to deliver quantities of fuel to accumulator 16 according to the various control methodologies described below.

Figure 2A:
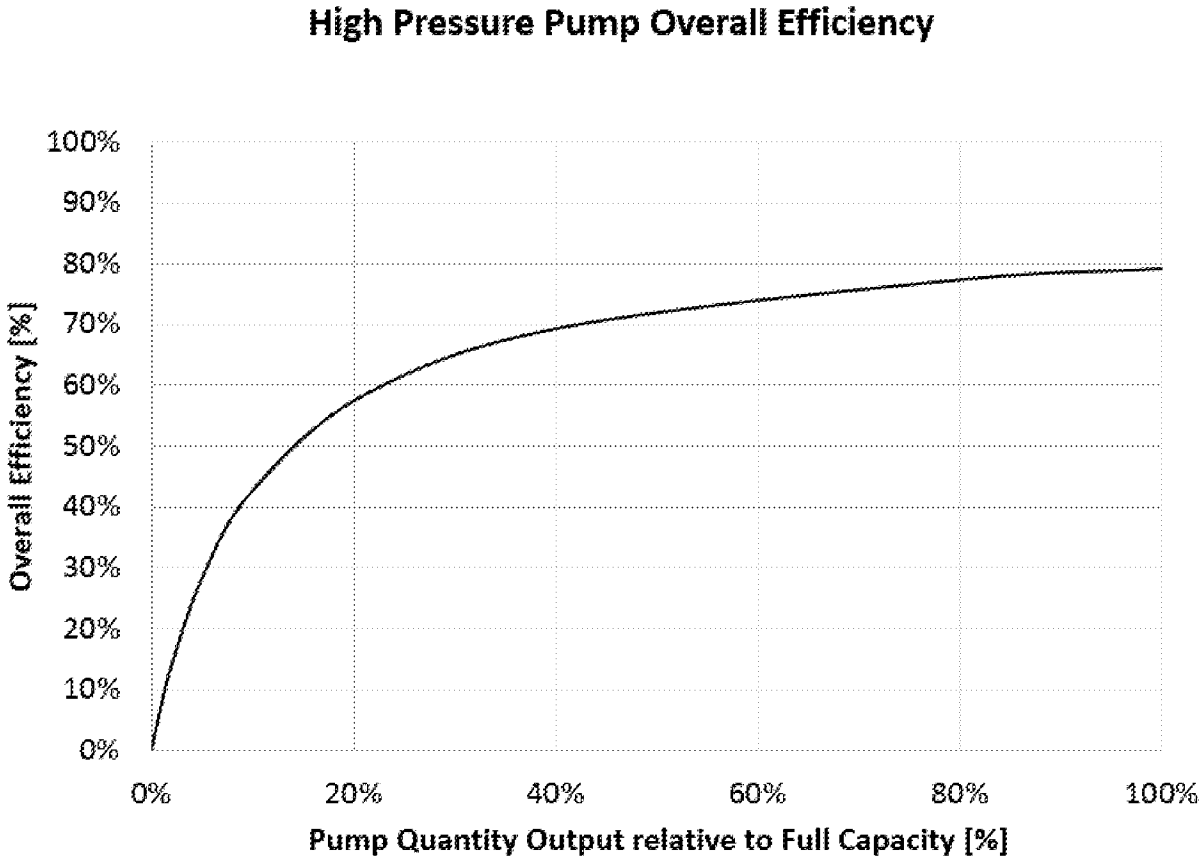
FIG. 2A is a graph of a typical efficiency profile of a high pressure fuel pump.

Pumps of all kinds have efficiency profiles which indicate the relationship of the energy efficiency of the pump relative to the output of the pump. A typical efficiency profile for a high pressure fuel pump such as pump 14 of FIG. 1A is depicted in FIG. 2A. As shown, the pump achieves its highest overall efficiency (approximately 80%) when delivering a pumped quantity that equals 100% of its pumping capacity. As is known in the art, fixed energy losses always exist that prevent any pump from achieving 100% efficiency. As is also shown in FIG. 2A, for pumped quantities below 40% and especially below 20%, the overall efficiency of the pump rapidly decreases. This example profile simply provides an illustration of the known principle that fuel pumps operate at higher efficiencies when operating at their maximum pumping capacity. This principle is used to achieve higher efficiency pump operation in a plurality of the control methodologies according to the present disclosure.

In a conventional fuel pump control methodology, controller 20 receives accumulator fuel pressure feedback from pressure sensor 36 and controls the operation of pump 14 so that a desired average pressure in accumulator 16 is achieved and maintained. When the pressure measured by pressure sensor 36 is low, controller 20 commands operation of pump 14 in such a way that more, higher pressure fuel is provided to accumulator 16. In a steady-state, time averaged operating condition, pump 14 provides the same amount of fuel to accumulator 16 as injectors 18 remove from accumulator 16 to deliver to cylinders 22.

Additionally, in a conventional fueling system 10, it is known that the pump selected must have a delivery capacity that is greater than will be required under the various operating conditions of engine 12. Under certain operating conditions (generally transient conditions), engine 12 will require a maximum amount of fuel, so the pump must be sized to deliver that quantity plus an additional margin (e.g., 15%, 20%, etc.) to account for other variables in the system. For example, fuel pumps may experience leakage under certain operating temperatures. Thus, fuel pumps are by necessity "over-designed." As a result, typical fuel pumps rarely operate at full capacity, which, as shown in FIG. 2A, results in undesirable efficiency.

While the present disclosure does not affect the "over-design" margin required for fuel pumps, it does provide various control methodologies for fuel pumps of various configurations to achieve different pump operation objectives, one of which is higher overall efficiency. More specifically, for pumps of varying physical configuration and driving mechanisms (e.g., gear coupling to crankshaft 26), the control methodologies of the present disclosure permit customizing pump operation to achieve greater efficiency, less audible noise, vibration and harshness, greater pump reliability/life cycle, more constant overall accumulator fuel pressure, and/or more constant fuel pressure during fuel injection events. Depending upon the operating conditions of the pump, a weighted or unweighted combination of these objectives may be achieved.

The above-mentioned control methodologies may be viewed as having one or more of the following four features: (1) binary pumping; (2) phased pumping; (3) gentle pumping; and (4) pumping to minimize injection pressure variations. As is described in greater detail below, binary pumping denotes operating each pumping element 30 during each pumping event in a binary or digital manner, such that the pumping element 30 outputs fuel at 100% of its capacity or 0% of its capacity. Phased pumping denotes operating pumping elements 30 to provide fuel delivery pumping events that are preferentially timed relative to the phasing of the injection events of fuel injectors 18. As is also further described below, gentle pumping denotes operating pumping elements 30 at certain rotational positions of camshaft 56 to reduce abrupt energy transients experienced by pump 14 resulting from fuel delivery. Finally, the feature described below for minimizing injection pressure variations includes operating pumping elements 30 in a manner that causes accumulator 16 to have the same or substantially the same fuel pressure at the start of or during each injection event of fuel injectors 18.

FIGS. 2B-2C provide an overview of characteristics of the systems and control methodologies depicted in FIGS. 3-31. The embodiments of FIGS. 2B-2C are not exhaustive, but rather are provided to illustrate alternative control methodologies for different pumping structures to achieve different goals. As indicated in FIGS. 2B-2C, FIGS. 3-12 and 31 depict operation of control methods for hardware configurations in which the pump has the potential to pump at twice the fuel injection frequency. FIGS. 13-16 depict operation of control methods in which the pump has the potential to pump at the injection frequency. FIGS. 17-30 depict operation of control methods in which the pumping events do not occur at a whole number multiple of the injection events. It should be understood, however, the pumping to injection ratio may be any value at all and still be contemplated by the present disclosure. Column two of FIGS. 2B-2C characterizes whether the desired rail pressure can be provided by a single pumping element 30.

Figure 3:
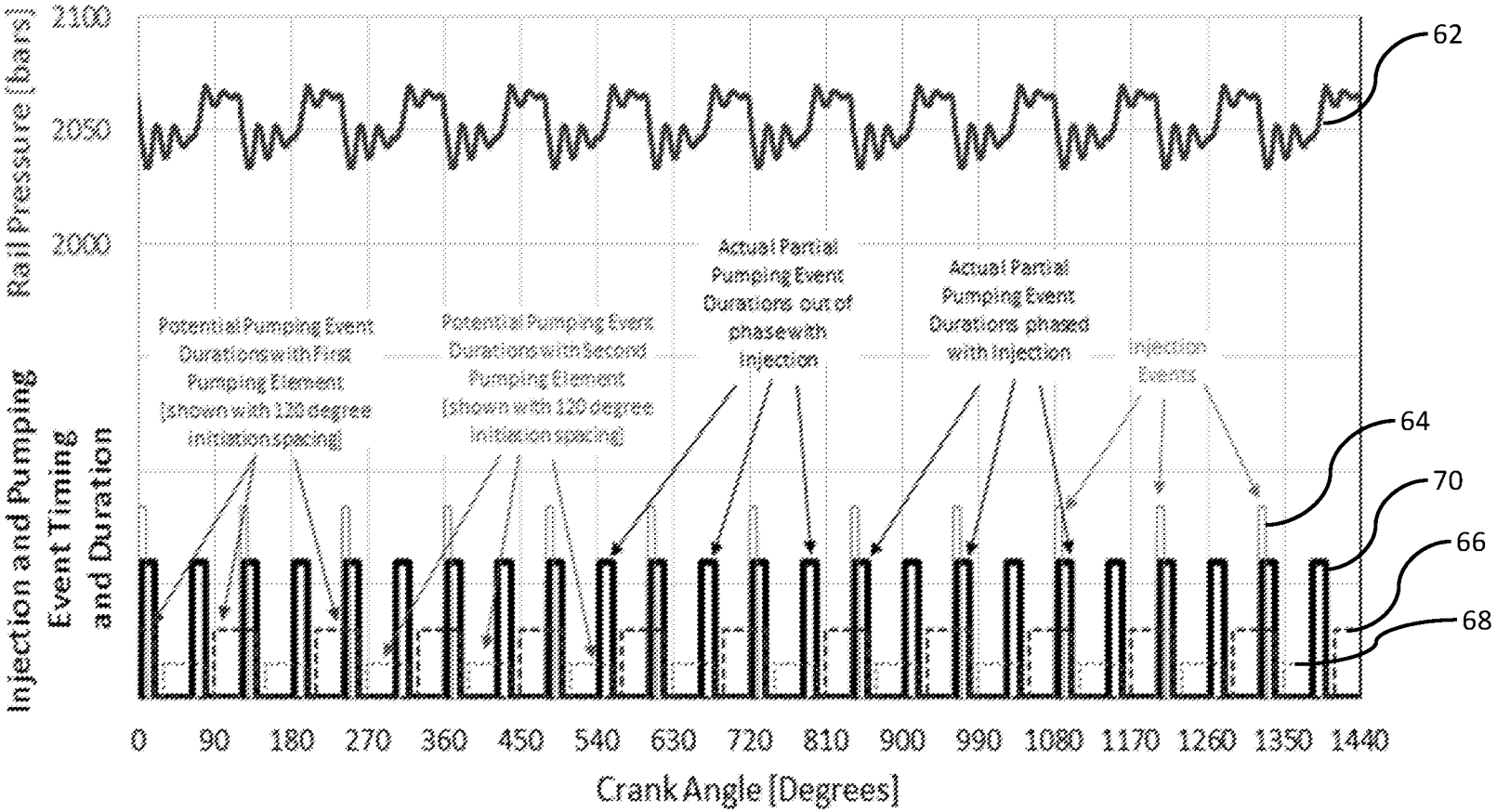
FIG. 3 (Prior Art)
FIG. 3 is a graph of results of a prior art control methodology for a first pumping configuration.

A baseline, prior art control methodology for a typical fueling system 10 having a pump 14 with two pumping elements 30 is shown in FIG. 3. In FIG. 3, rail pressure 62 (as measured by pressure sensor 36 in bars) is shown varying with time (expressed in degrees of rotation of crankshaft 26 or crank angle) as a result of pumping events and injection events. Injection events 64 are depicted as pulses during which one or more fuel injectors 18 inject fuel into one or more cylinders 22 of engine 12. Injection events 64 in this example occur at 120 degree intervals such as during operation of a six cylinder engine. Potential pumping events 66 (shown in dotted lines) represent the time periods (again, expressed in crank angle degrees) during which a first pumping element 30 of the two pumping element 30 fuel pump 14 may be controlled to deliver fuel. As shown, in this example system, potential pumping events 66 have an initiation spacing of 120 degrees. Similarly, potential pumping events 68 (shown in dotted lines) represent time periods during which a second pumping element 30 may be controlled to deliver fuel. Potential pumping events 68 also occur at an initiation spacing of 120 degrees. Potential pumping events 66, 68 are shown as having different heights merely to more easily distinguish between them visually.

Finally, actual pumping events 70 show the timing and duration of the use of control elements 30 to actually deliver fuel to accumulator 16.

As should be apparent from the foregoing, FIG. 3 depicts operation of a system having a 2× ratio between potential pumping events 66, 68 and injection events 64 (hereinafter, "a 2× pumping to injection ratio"). In other words, potential pumping events 66, 68 together occur at twice the frequency as injection events 64. In this example, a prior art control methodology is depicted wherein actual pumping pulses 70 of substantially less than 100% fuel delivery occur at the end of each potential pumping event 66, 68. The pumped fuel quantity is delivered from the start of pumping (i.e., after pump plunger 54 is at bottom-dead-center ("BDC")) and depends on the pumped quantity up to a time when pump plunger 54 is near top-dead-center ("TDC"). The quantity of fuel delivered is affected by determining when to start pressurizing the fuel and controlling the quantity of fuel delivered to the pumping element 30 via inlet valve 46. As can be seen in FIG. 3, each time an actual pumping event 70 occurs, rail pressure 62 increases and each time an injection event 64 occurs, rail pressure 62 decreases.

As indicated above, the efficiency of a pump increases as the delivered quantity of the pump increases. In order to increase the efficiency of the pump, a binary pumping methodology can be utilized. In binary pumping, rail pressure 62 of the system is controlled using individual pumping events which are controlled to be either 100% delivery or 0% delivery. As a result of this control methodology, the efficiency of the pump and resulting fuel economy of the system can be improved. As shown, the typical control methodology of FIG. 3 does not use binary pumping, but instead controls actual pumping events 70 of less than 100% (i.e., lower efficiency) to occur during every potential pumping event 66, 68.

Figure 4:
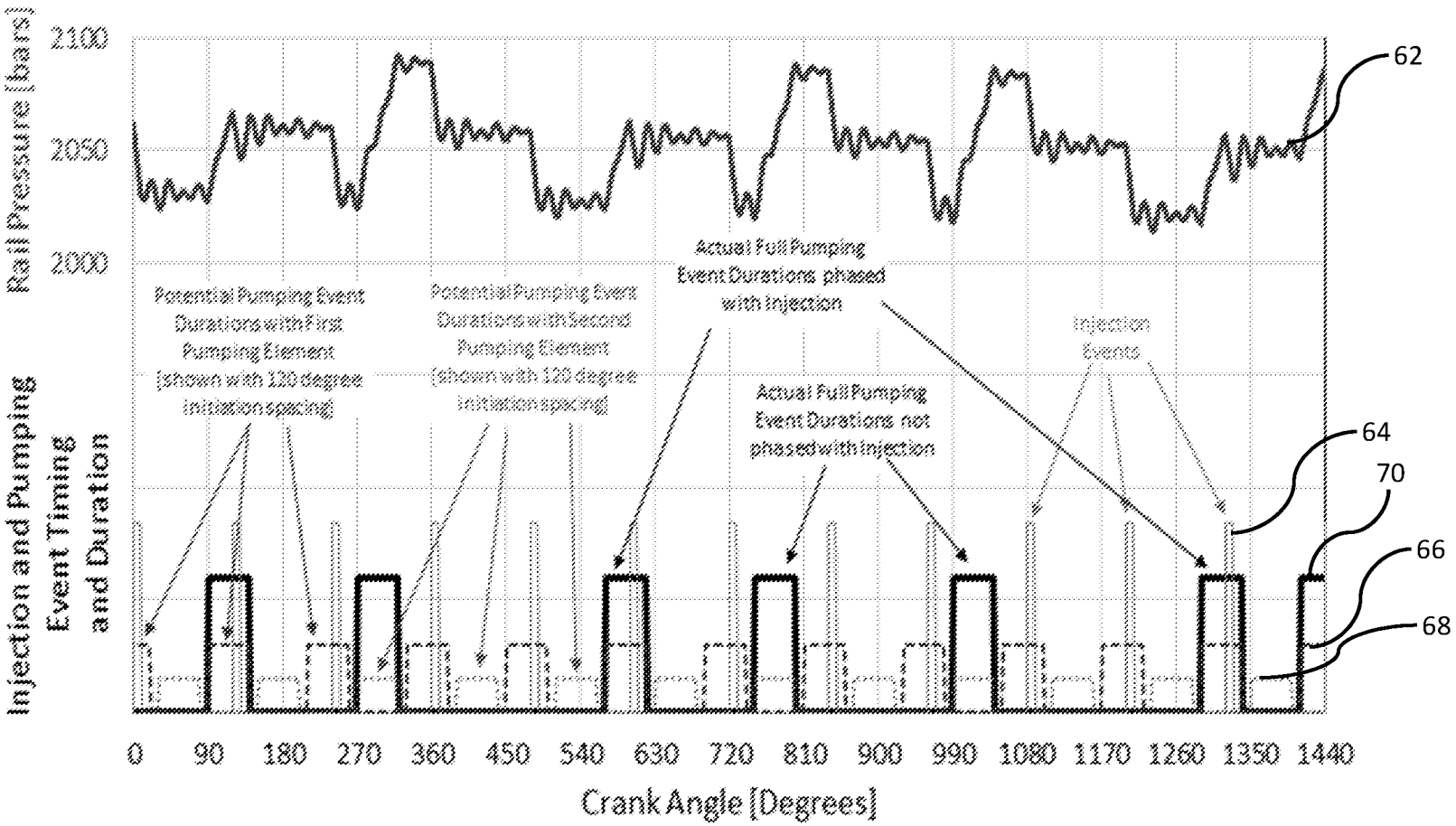
FIGS. 4-12 are graphs of results of control methodologies according to the present disclosure used with the pumping configuration of FIG. 3.

Referring now to FIG. 4, using a binary pumping methodology according to the present disclosure actual pumping events 70 of 100% fuel delivery are controlled as needed to maintain rail pressure 62 and achieve higher efficiency relative to the methodology of FIG. 3. As shown, potential pumping events 66, 68 are the same as those shown in FIG. 3, but rather than cause a short duration (i.e., low delivery percentage) actual pumping event 70 as in FIG. 3 during each potential pumping event 66, 68, in FIG. 4 each of the actual pumping events 70 provides 100% fuel delivery (i.e., they use the entire duration of potential pumping event 66 or 68) and they do not occur during each potential pumping event 66, 68. As 100% delivery actual pumping events 70 achieve the highest efficiency (see FIG. 2A), the control methodology underlying FIG. 4 is more efficient than that underlying FIG. 3.

As can be seen in FIG. 4, however, rail pressure 62 is noisier (or fluctuates more) than in FIG. 3. After each large actual pumping event 70 in FIG. 4, rail pressure 62 increases substantially. Rail pressure 62 then decreases after each injection event 64. In this example, when rail pressure 62 reaches a low pressure threshold, and rail pressure 62 will be insufficient for the next injection event 64, a 100% delivery actual pumping event 70 is provided. In this sense, the control methodology anticipates future demand of fuel injectors 18. As an example, an actual pumping event 70 was not generated at 540 degrees during potential pumping event 68 even though rail pressure 62 was at a low pressure threshold. The control methodology anticipated that the next injection event 64 would occur during the next potential pumping event 66 and the actual pumping event 70 provided during potential pumping event 66 would increase rail pressure 62 enough to satisfy the demand of that injection event 64. It should be understood that actual pumping events 70 may be triggered by events other than rail pressure 62 reaching a low pressure threshold such as, for example, deviation from a maximum pressure, an average pressure, etc.

Figure 5:
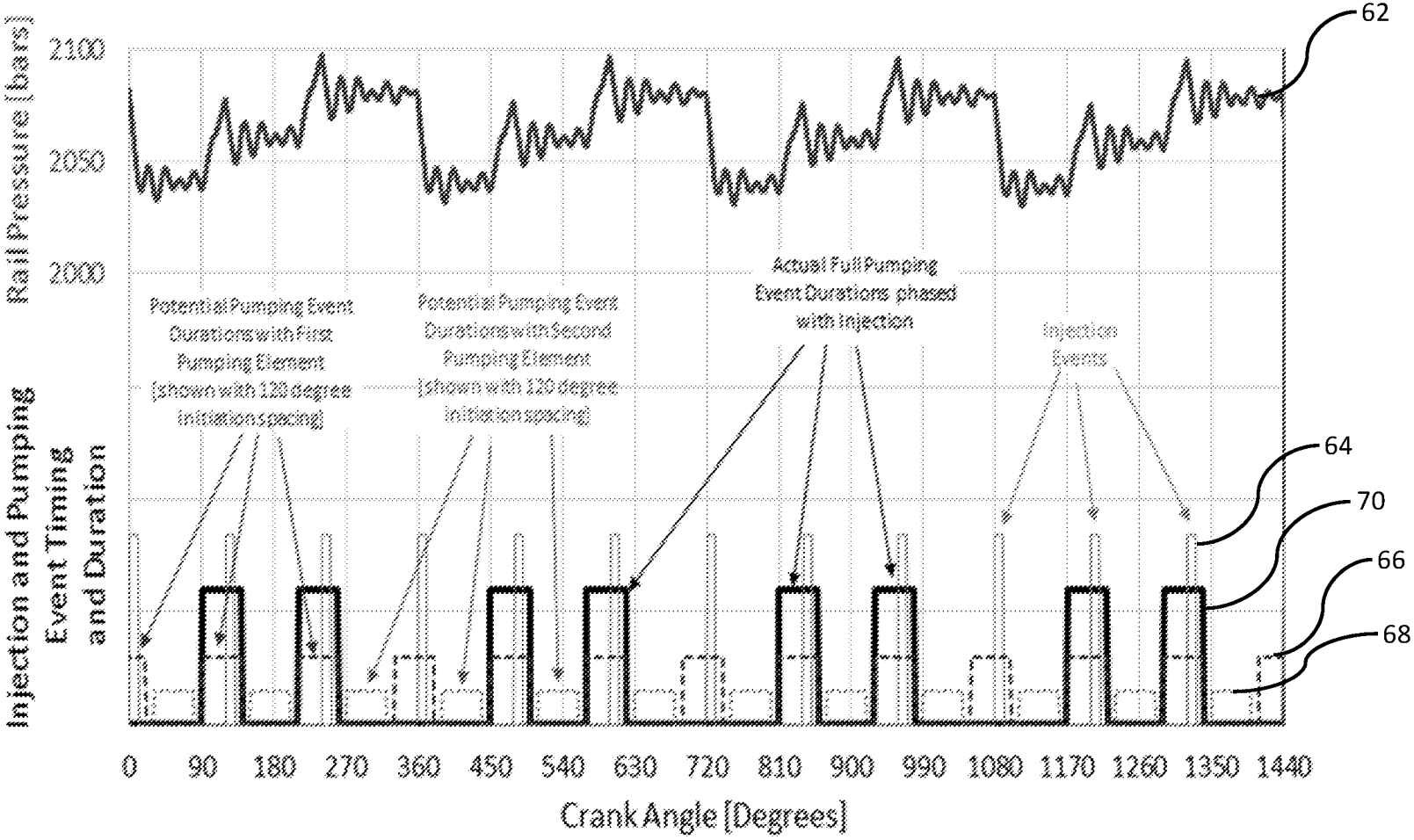

Referring now to FIG. 5, in this binary pumping control methodology actual pumping events 70 of 100% fuel delivery are controlled to achieve high efficiency and to occur at a preferred phasing relationship with injection events 64. Whereas in FIG. 4 some of actual pumping events 70 were at a preferred phasing relationship relative to injection events 64 and some were not, in FIG. 5 all actual pumping events 70 are at a preferred phasing relationship relative to injection events 64. In some engine and system configurations, the audible noise, vibration and harshness interaction of a pump and the engine in which it is utilized can be improved by controlling the relative phasing of actual pumping events 70 and injection events 64 during selected operating conditions in the manner depicted in FIG. 5. Moreover, each actual pumping event 70 occurs only during potential pumping events 68, not during potential pumping events 66. This mode of control may be used when one of pumping elements 30 is potentially malfunctioning or its durability is in question.

Figure 6:
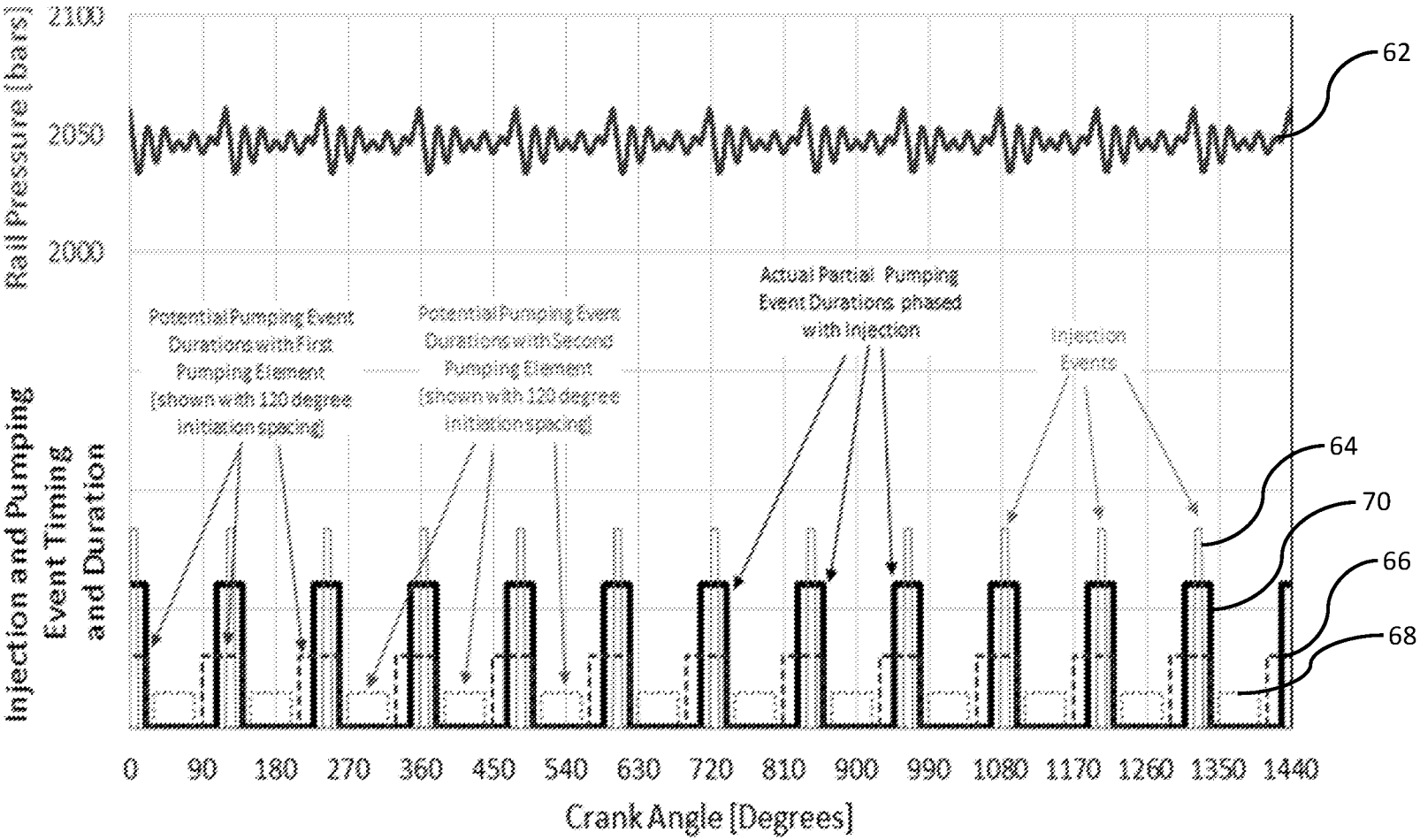

Referring now to FIG. 6, in this control methodology all actual pumping events 70 are at a preferred phasing relationship relative to injection events 64 and occur only once per injection event 64. This control methodology provides phased pumping using only one pumping element 30 (i.e., the pumping element 30 corresponding to potential pumping events 66) and results in decreased audible noise. It should be understood that actual pumping events 70 would not have to occur at the same time as injection events 64. They could occur before or after injection events 64 but at the same crank angle offset from the injection events 64 each time. It should also be noted that actual pumping events 70 of FIG. 6 result in higher efficiency than those in FIG. 3. If the actual pumping events 70 of FIG. 3 represent, for example, 30% fuel delivery and the actual pumping events 70 of FIG. 6 represent 60% fuel delivery, then it should be clear from the foregoing that a 60% delivery event 70 and a 0% delivery event 70 per injection event 64 (as shown in FIG. 6) is more efficient than two 30% delivery events 70 (as shown in FIG. 3). Moreover, as shown in FIG. 6 rail pressure 62 exhibits very little variation compared to the rail pressures 62 of the preceding figures. Thus, the control methodology underlying FIG. 6 provides increased efficiency, reduced audible noise and steady rail pressure 62 using a single pumping element 30.

Figure 7:
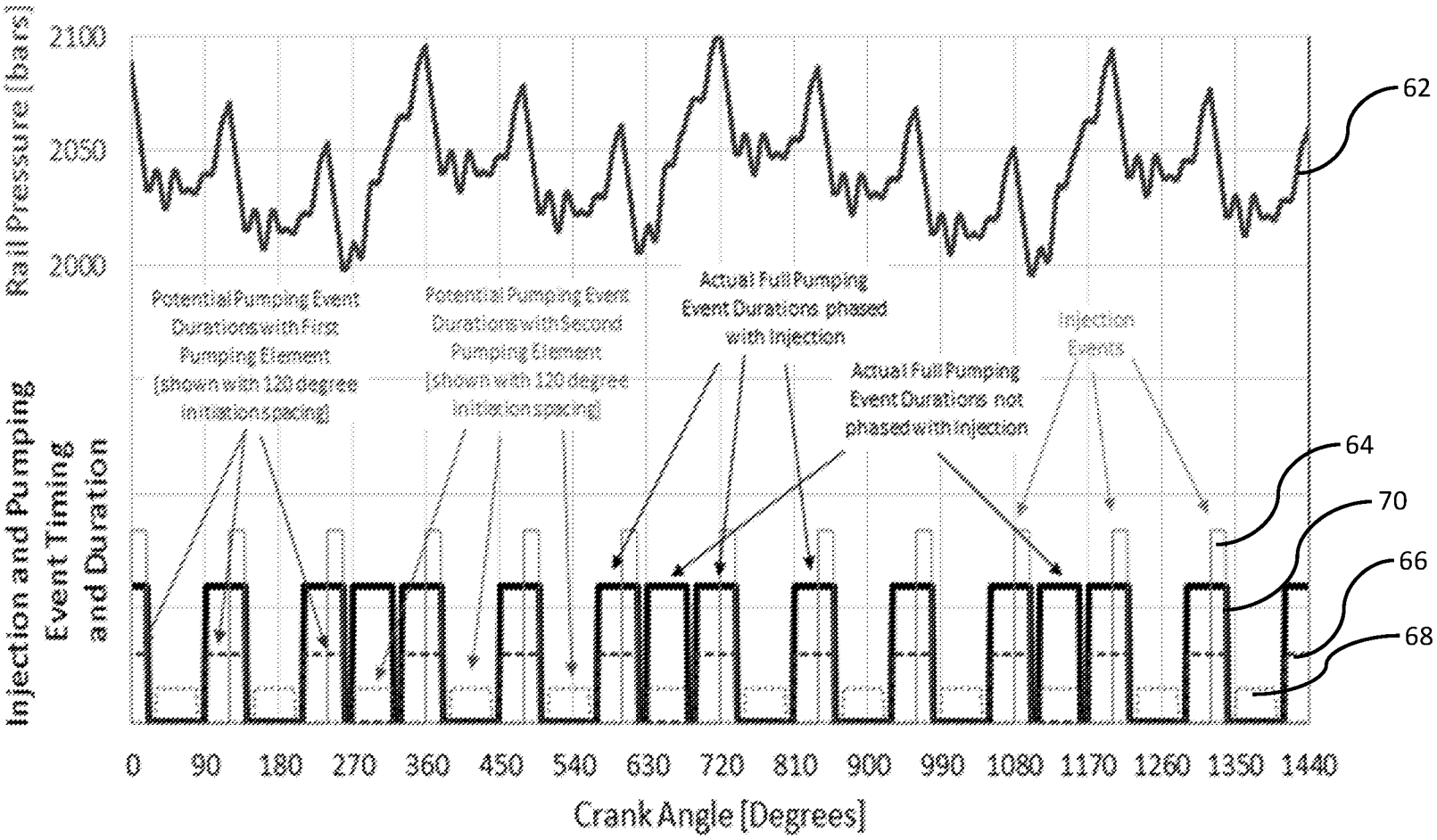

Referring now to FIG. 7, another control methodology is depicted that combines binary pumping (for increased efficiency) and phased pumping (for decreased audible noise, vibration and harshness). In this example, all actual pumping events 70 are 100% fuel delivery, leading to improved efficiency (e.g., relative to the control methodology of FIG. 6). Most actual pumping events 70 (i.e., those occurring during potential pumping events 66) are at a preferred phasing relationship relative to injection events 64, leading to reduced audible noise. However, in this example the actual pumping events 70 that are at a preferred phasing relationship relative to injection events 64 are insufficient to deliver enough fuel to accumulator 16 to maintain a desired rail pressure 62. Accordingly, when rail pressure 62 falls to a low pressure threshold, an actual pumping event 70 that is not at a preferred phasing relationship relative to injection events 64 is generated (e.g., during potential pumping events 68 at approximately 270 degrees, 630 degrees and 1100 degrees).

Figure 8:
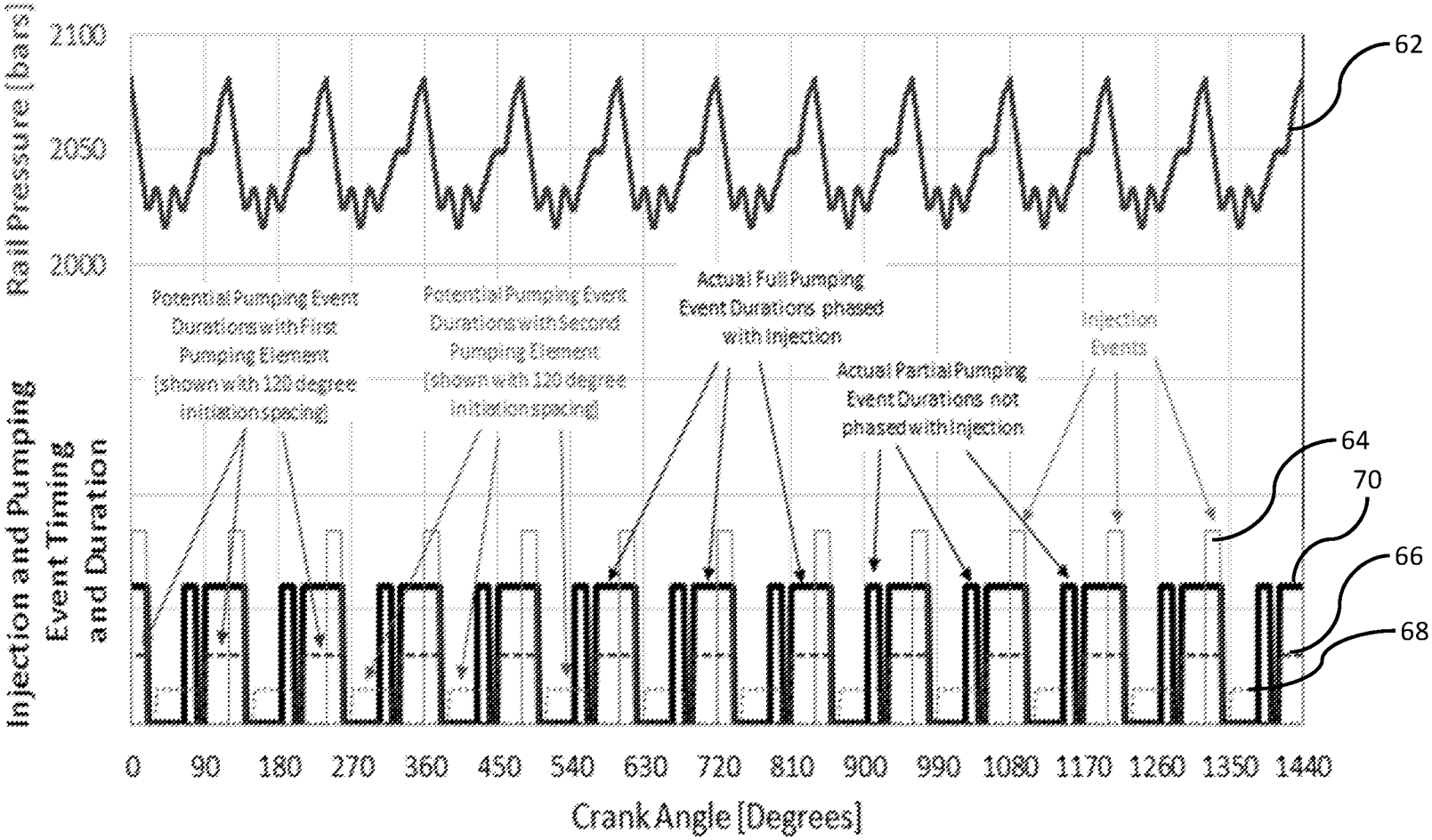

FIG. 8 depicts another control methodology that employs partial binary pumping and partial phased pumping. In this example, all actual pumping events 70 that occur during potential pumping events 66 are 100% fuel delivery events, and are at a preferred phasing relationship relative to injection events 64. As was the case in FIG. 7, these actual pumping events 70 are insufficient to meet the demand to maintain a desired rail pressure 62. Unlike the control methodology of FIG. 7, which periodically generated a 100% delivery actual pumping event 70 during a potential pumping event 66 as needed to maintain rail pressure 62, here a small delivery actual pumping event 70 is generated during every potential pumping event 68 which results in a more stable rail pressure 62, although at the cost of a somewhat decreased overall efficiency.

Figure 9:
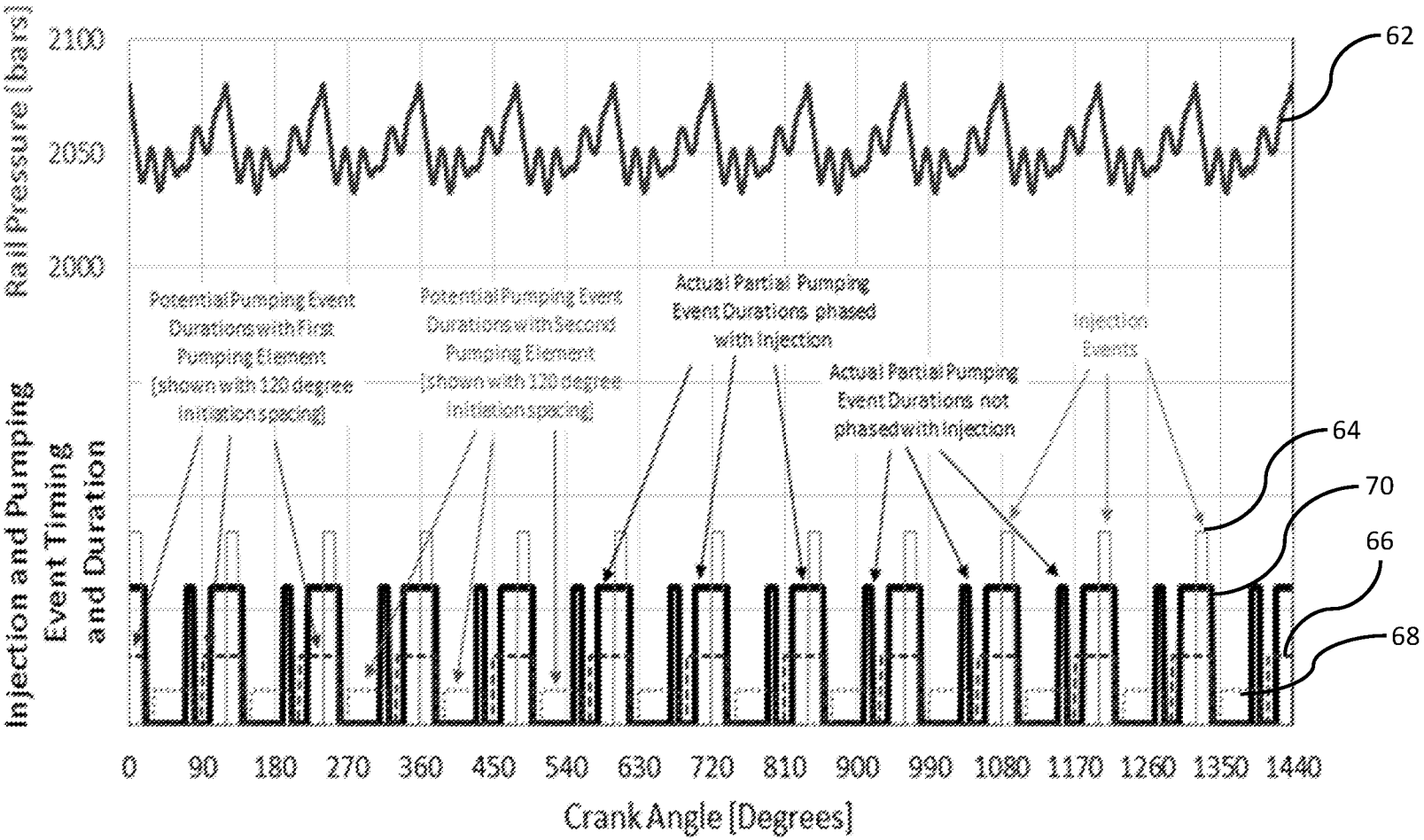

Referring now to FIG. 9, another control methodology is shown that employs partial phased pumping. FIGS. 9-12 all depict control methodologies that place a priority on avoiding an undesired delivery percentage. Unlike the methodology of FIG. 8, in FIG. 9 the actual pumping events 70 that are at a preferred phasing relationship relative to injection events 64 during potential pumping events 66 are less than 100% delivery events. The actual pumping events 70 that are not at a preferred phasing relationship relative to injection events 64 during potential pumping events 68 are also somewhat smaller than those in FIG. 8. Overall, however, the same quantity of fuel is delivered to accumulator 16, but using the methodology underlying FIG. 9, a more steady rail pressure 62 is maintained, albeit at a further cost of a somewhat decreased overall efficiency.

Figure 10:
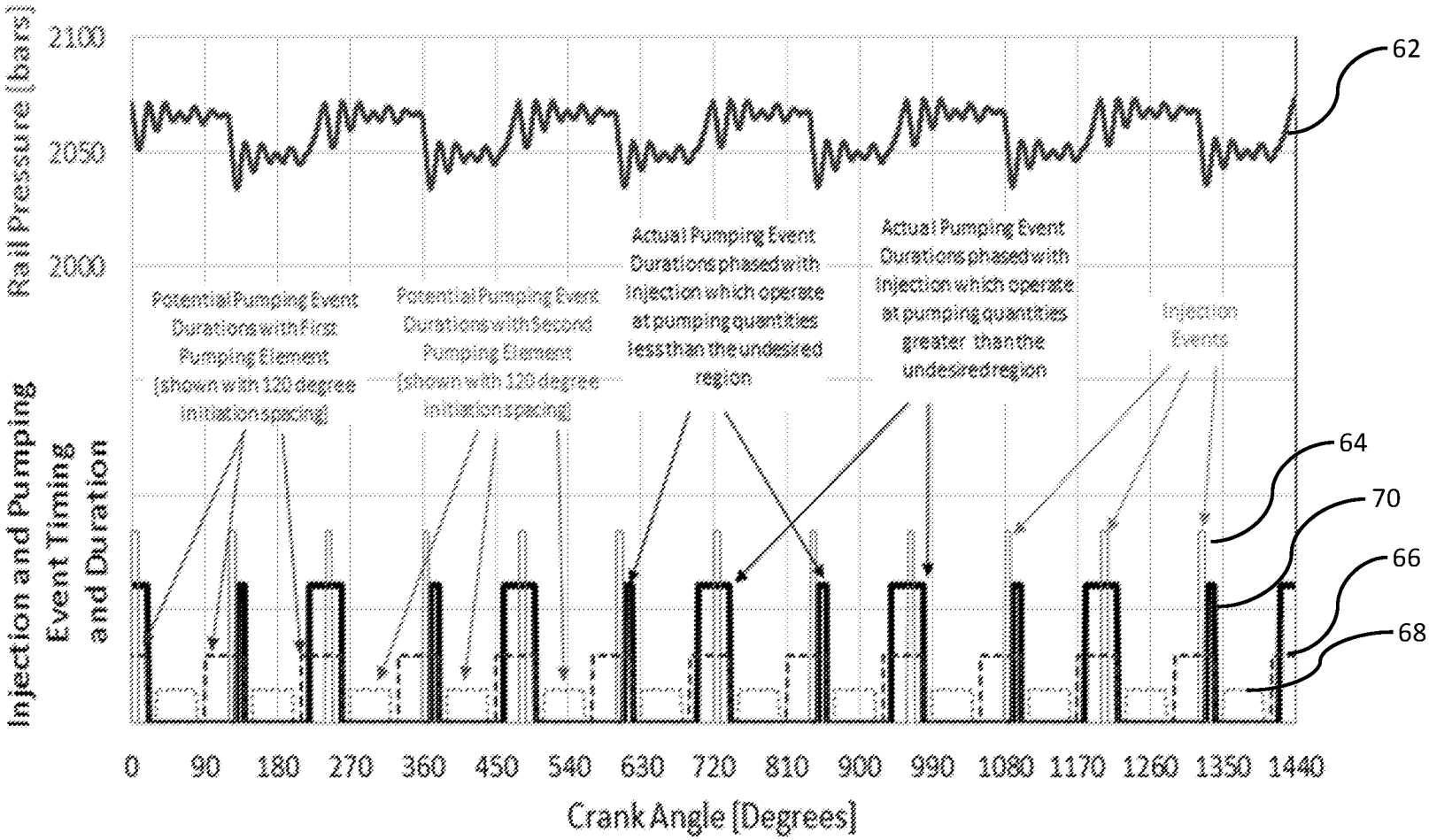

The control methodology of FIG. 10 is also designed for situations wherein a particular fuel delivery percentage per pumping event is considered undesirable. For some systems there are operating regions of the pumping elements 30 which are non-optimal with respect to durability and reliability. For example, the dynamic pressure within the pump 14 is often the highest when the pumping quantity is in the central region of the pump delivery capacity as is further explained below. In these cases, to improve the durability and reliability of a pump and the engine system, a pumping control methodology can be utilized which puts priority on actual pumping events 70 which do not operate in regions which could have undesired effects. In the example of FIG. 10, actual pumping events 70 that occur only during potential pumping events 66 are sufficient to meet the demand and maintain rail pressure 62 within a desired range. All of the actual pumping events 70 are at a preferred phasing relationship relative to injection events 64. Here, however, half of the actual pumping events 70 deliver a quantity of fuel above the undesirable fuel delivery percentage and half of the events 70 deliver a quantity of fuel below the undesirable fuel delivery percentage. Thus, the control methodology of FIG. 10 permits pumping elements 30 to avoid an undesirable delivery percentage, to operate at a preferred phasing relationship relative to injection events 64 (thereby reducing noise), and to maintain a relatively stable rail pressure 62.

Figure 11:
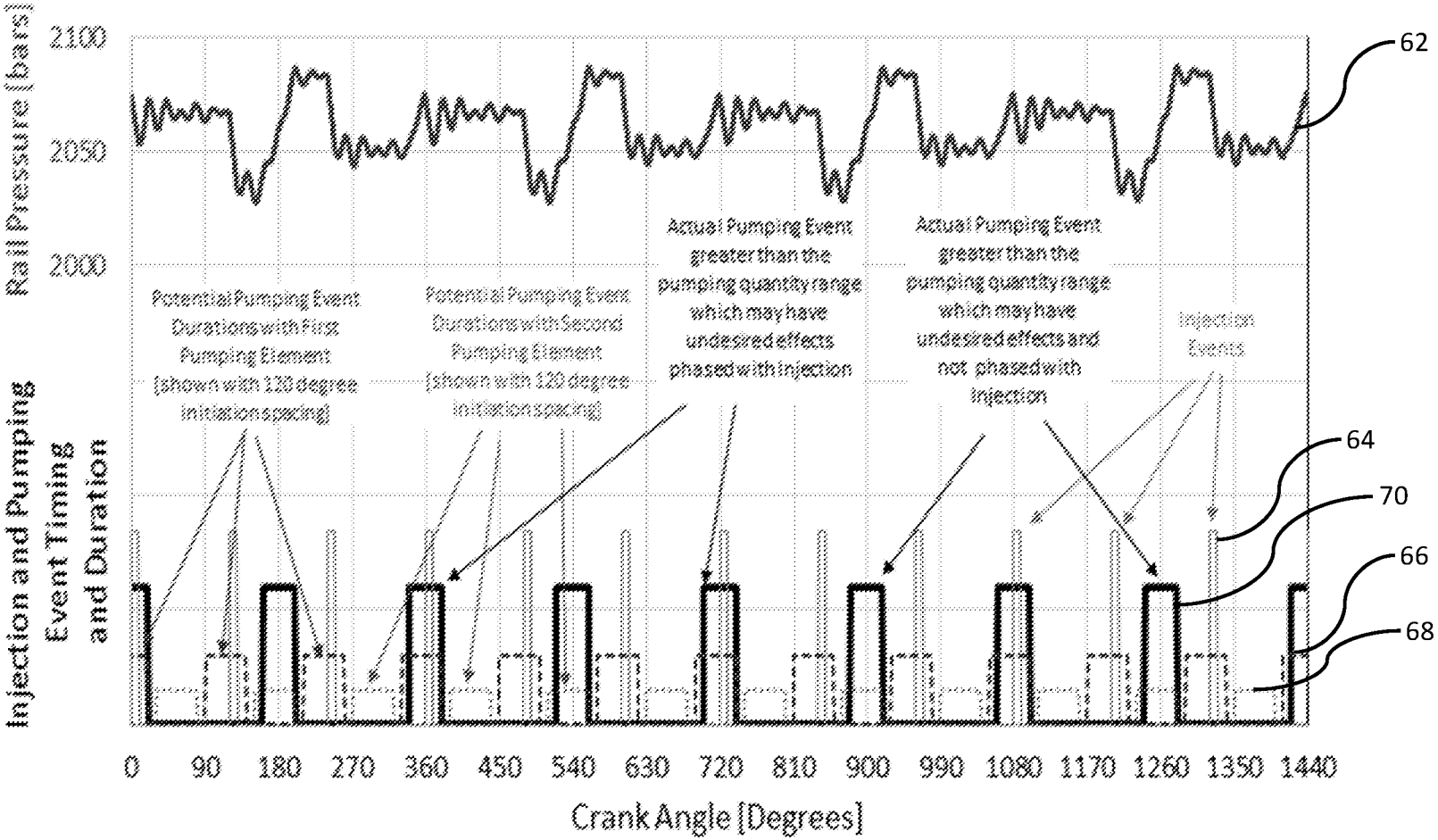

The control methodology of FIG. 11 is similar to that of FIG. 10 except that all of the actual pumping events 70 deliver a quantity of fuel that is greater than the undesirable fuel delivery percentage. In this example, every other actual pumping event 70 (e.g., at 180 degrees, 540 degrees, 900 degrees, 1260 degrees, etc.) occurs not at a preferred phasing relationship relative to injection events 64 as needed to maintain rail pressure 62 within a desired range. Approximately the same amount of fuel is delivered in the system of FIG. 11 as in the system of FIG. 10, but the methodology underlying FIG. 11 achieves a higher overall efficiency because all actual pumping events 70 are nearly 100% fuel delivery. This efficiency increase is at a cost of increased noise because of the events 70 that are not at a preferred phasing relationship relative to injection events 64 and a somewhat less stable rail pressure 62. As should be apparent from the foregoing, in FIG. 11 actual pumping events 70 are very similar, and therefore deliver a similar pumping quantity that is configured to be in a range that should not produce undesired effects, and the pumping frequency is consistent.

Figure 12:
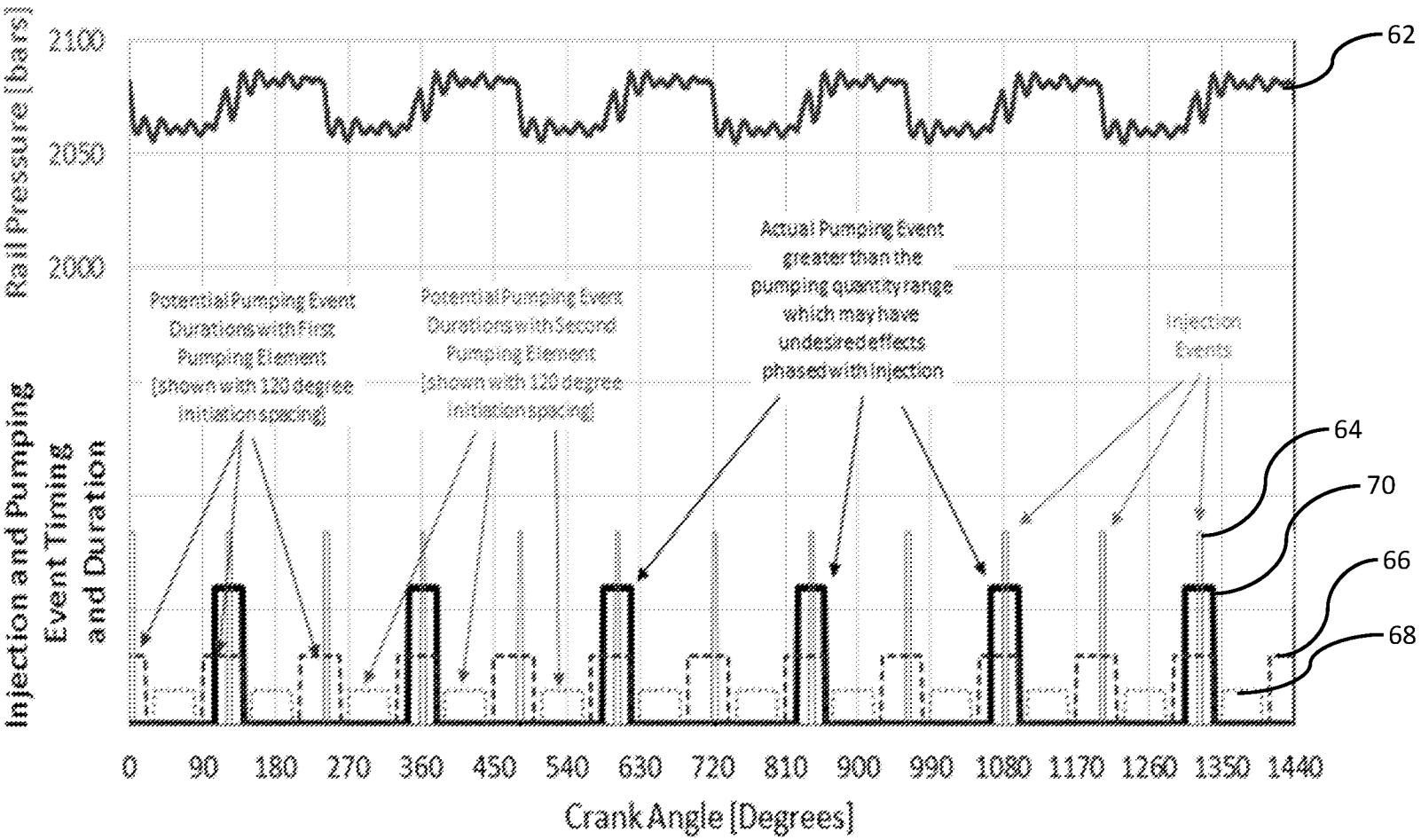

The control methodology of FIG. 12 is also similar to that of FIG. 10 except that all of the actual pumping events 70 deliver a quantity of fuel that is greater than the undesirable fuel delivery percentage and all of the events 70 are at a preferred phasing relationship relative to injection events 64. In the example of FIG. 12, unlike FIG. 10, the actual pumping events 70 that are at a preferred phasing relationship relative to injection events 64 are sufficient to meet the demand and maintain rail pressure 62 within a desired range.

Figure 13:
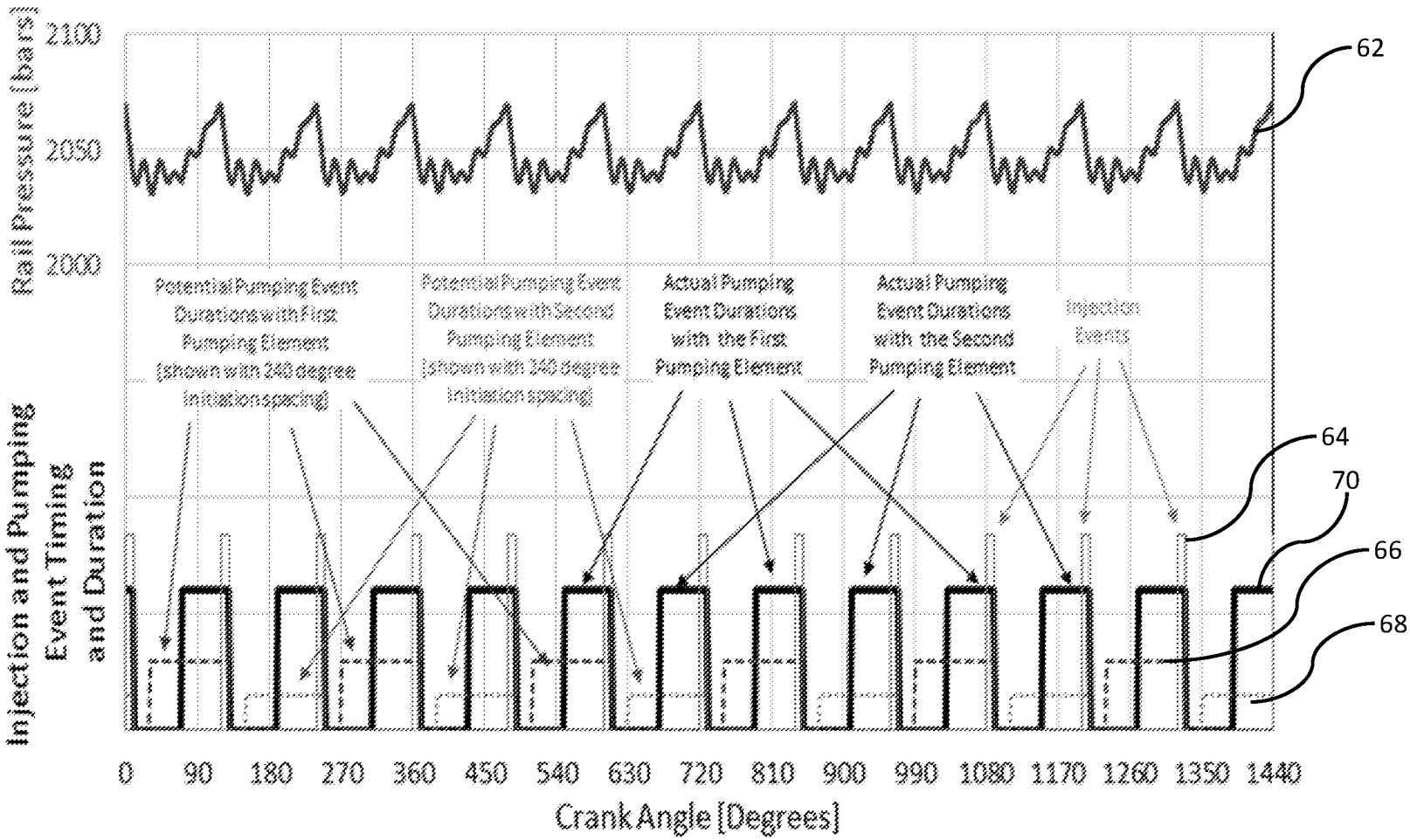
FIG. 13 (Prior Art)
FIG. 13 is a graph of results of a prior art control methodology for a second pumping configuration.

Referring now to FIG. 13, a baseline, prior art control methodology is illustrated for a system having a 1× ratio between potential pumping events 66, 68 and injection events 64 (hereinafter, "a 1× pumping to injection ratio"). One potential pumping event 66 or 68 occurs for each injection event 64. Using a conventional control methodology, an actual pumping event 70 of less than 100% delivery is generated during each potential pumping event 66, 68 to maintain rail pressure 62 within a desired range. This does not achieve enhanced efficiency, but results in relatively low noise (all actual pumping events 70 are at a preferred phasing relationship relative to injection events 64) and a relatively stable rail pressure 62.

Figure 14:
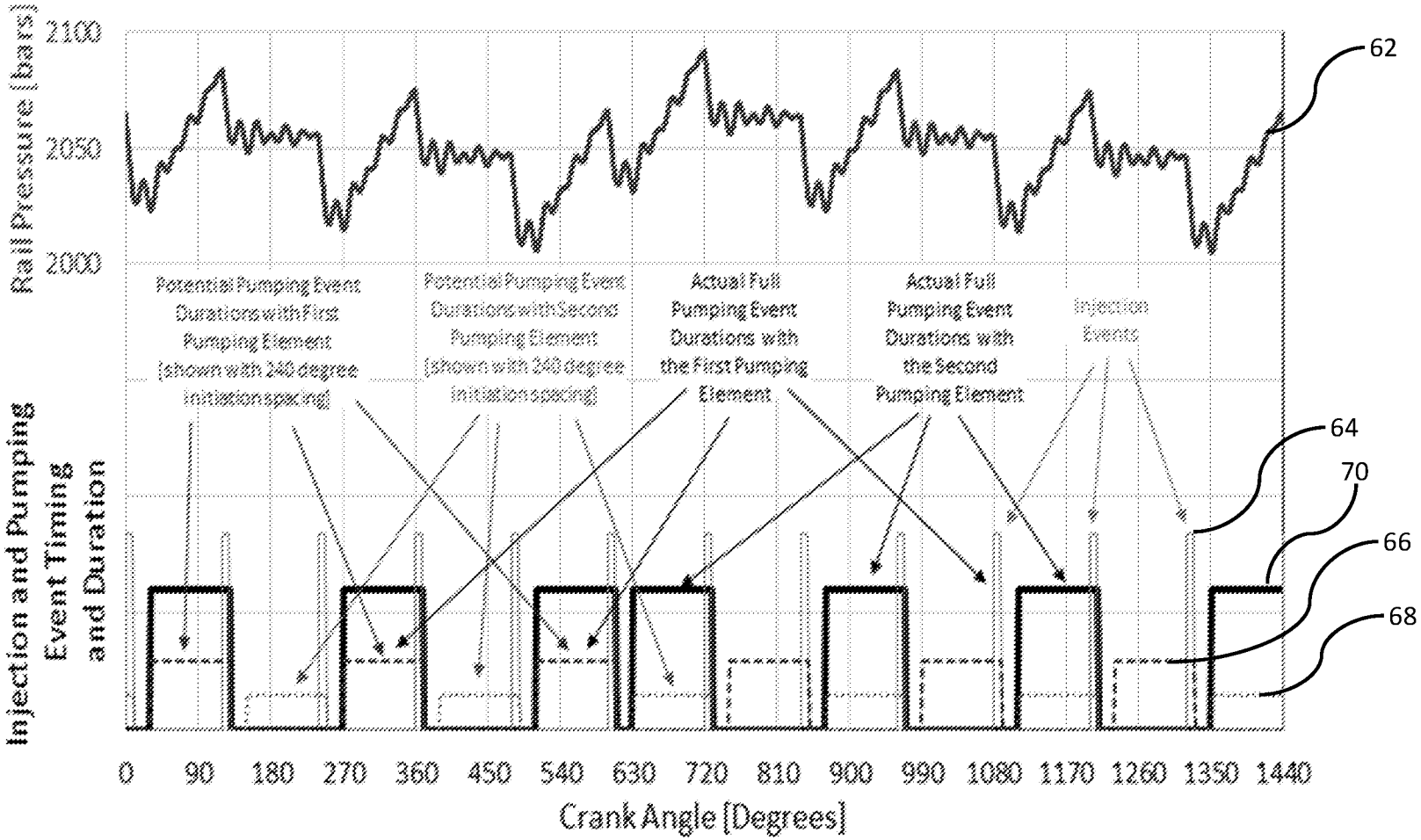
FIG. 14-16 are graphs of results of control methodologies according to the present disclosure used with the pumping configuration of FIG. 13.

FIG. 14 depicts the results of a binary pumping control methodology according to the present disclosure used with the 1× pumping to injection ratio system of FIG. 13. As shown, each actual pumping event 70 provides 100% fuel delivery and occurs as needed to insure that rail pressure 62 will be sufficient for the next injection event 64. Consequently, an actual pumping event is not required during each potential pumping event 66, 68. While the binary pumping results in improved efficiency as compared to the control methodology underlying FIG. 13, rail pressure 62 shows more variation.

Figure 15:
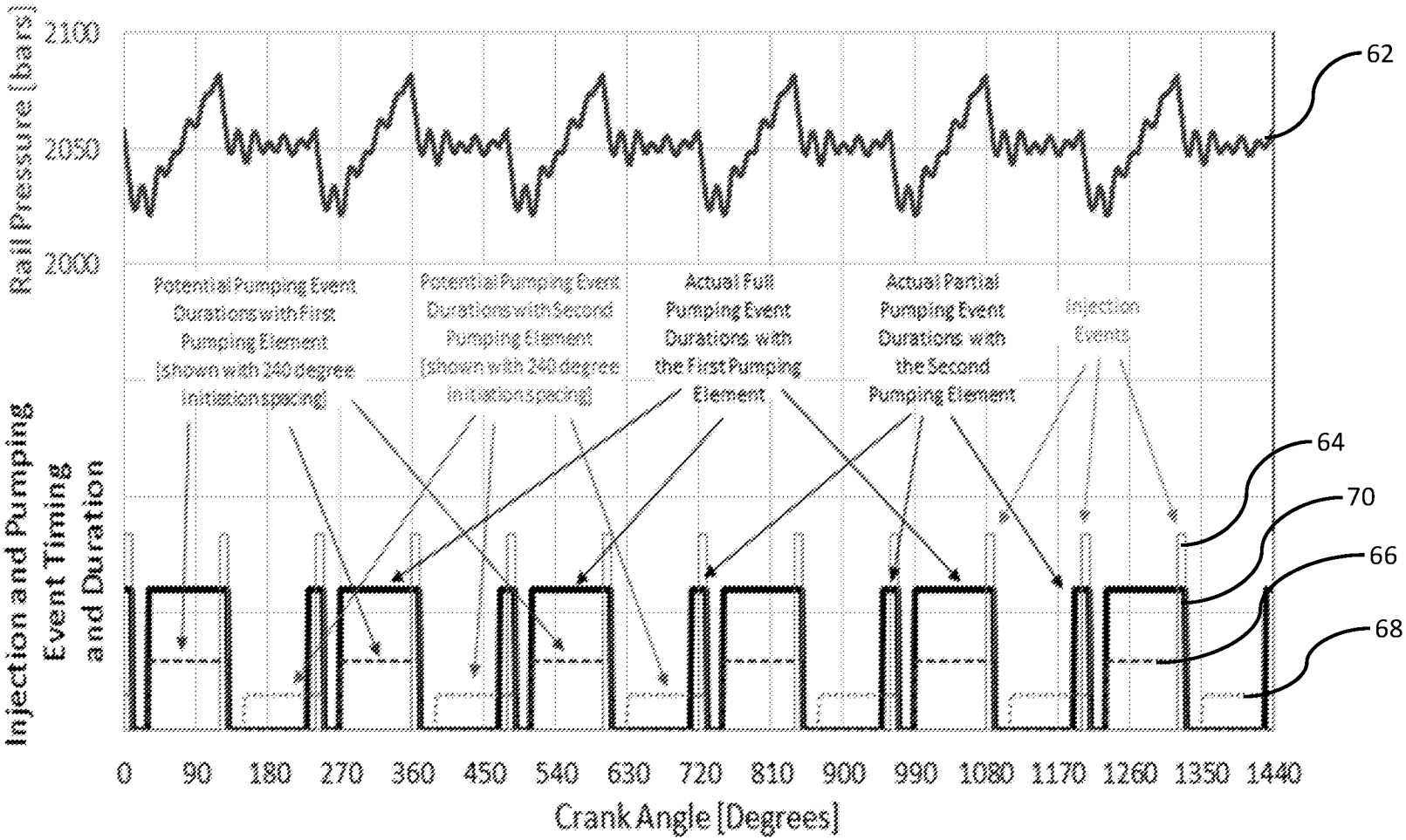

Referring now to FIG. 15, a partially binary control methodology is used for a system where the required fuel quantity cannot be satisfied by a single pumping element 30. Here, a 100% delivery actual pumping event 70 is generated during each potential pumping event 66, but that is not enough fuel to maintain rail pressure 62 within the desired range. Therefore, a small actual pumping event 70 is generated during each potential pumping event 68 to supply the necessary fuel. The result is a reduced efficiency as compared to that of the methodology underlying FIG. 14.

Figure 16:
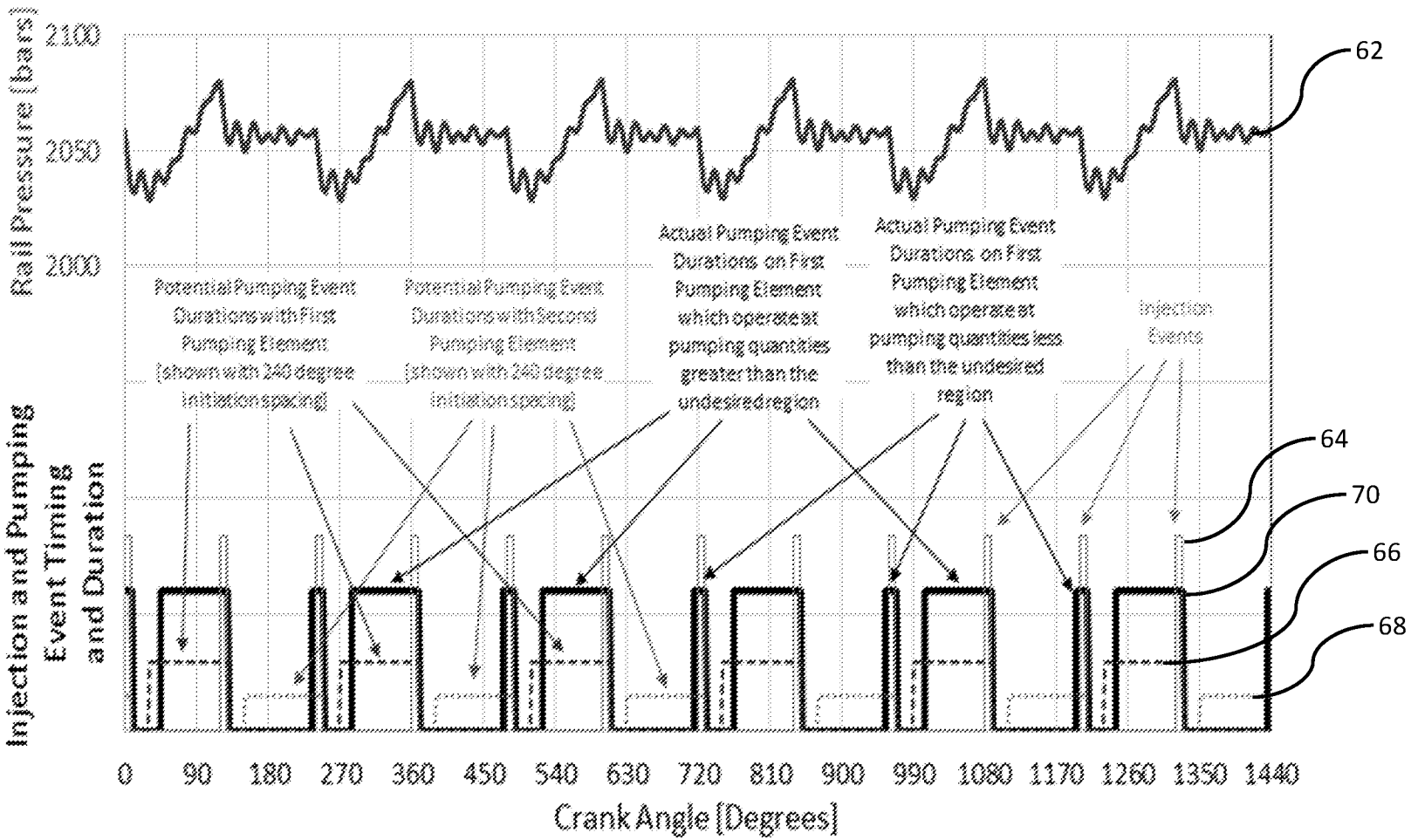
Figure 17:
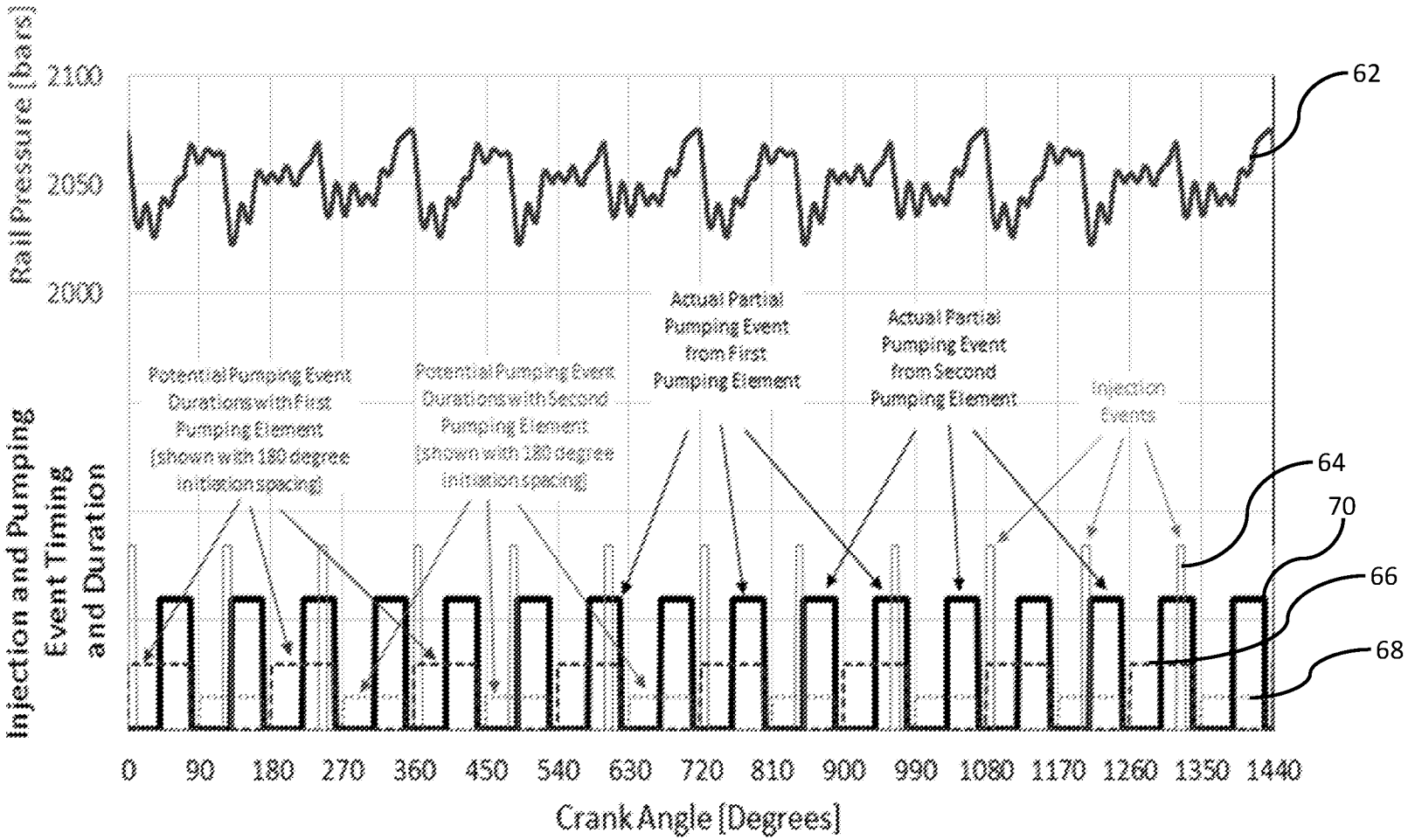
FIG. 17 (Prior Art)
FIG. 17 is a graph of results of a prior art control methodology for a third pumping configuration.

Referring now to FIG. 16, the results of a control methodology are shown where gentle pumping is a controlling consideration. In this example, reliability of pump 14 is a primary consideration. As describe above with reference to FIG. 10, certain operating regions of pumping elements 30 are non-optimal with respect to durability and reliability. More specifically, as shown in FIG. 1B during certain portions (indicated at 60A) of rotation of camshaft 56, plunger 54 moves at maximum velocity (e.g., where lobe 60 is less sharply curved between the BDC position of plunger 54 and the TDC position of plunger 54). During these high velocity regions for plunger 54 with pump outlet valve 48 closed, high stresses may be experienced by pump 14 (and in particular pumping element 30) as a result of high pressure amplitude fluctuations where the geometry of cam lobe 60 and roller 42 result in a region in which the rate of change of the axial displacement of plunger 54 is maximized. In these regions, for example, the fuel in pumping element 30 may transition to vapor, causing potential cavitation. Thus, during gentle pumping (which may be utilized during high speed engine operation), these high velocity regions are avoided during pumping events Referring now to FIG. 17, a prior art control methodology is shown for a system wherein potential pumping events 66, 68 are not spaced at a whole number multiple of injection events 64 (unlike the systems of FIGS. 3-12 which are at a 2× spacing and FIGS. 13-16 which are at a 1× spacing). In this system, potential pumping events 66 are spaced 180 degrees apart, as are potential pumping events 68, rather than 120 degrees or 240 degrees as with the figures discussed above. Injection events 64, however, remain spaced 120 degrees apart. As such, the potential pumping event 66, 68 to injection event 64 spacing ratio for the system underlying FIG. 17 is 1.5 (hereinafter, "a 1.5 pumping to injection ratio"). In the prior art control methodology underlying FIG. 17, partial actual pumping events 70 are generated during every potential pumping event 66, 68 to control rail pressure 62 to within a desired range. As should be apparent from the foregoing, use of such partial actual pumping events 70 results in decreased overall pump efficiency.

Figure 18:
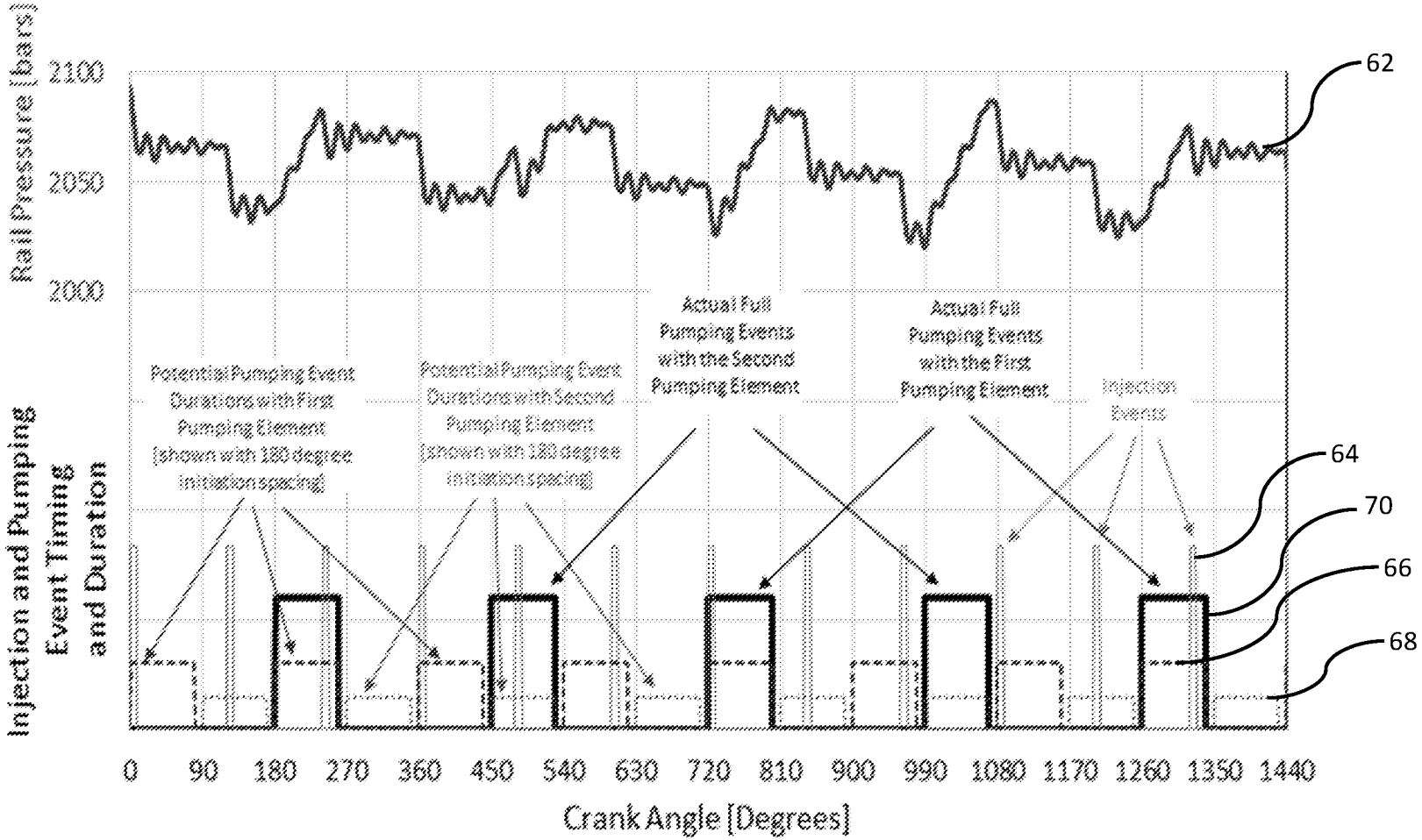
FIGS. 18-30 are graphs of results of control methodologies according to the present disclosure used with the pumping configuration of FIG. 17.

FIG. 18 depicts operation of a 1.5 pumping to injection ratio system configuration using binary pumping according to the present disclosure. As shown, all actual pumping events 70 provide 100% fuel delivery. In this example, intermittent binary pumping is capable of maintaining rail pressure 62 within a desired pressure range. Actual pumping events 70 are not at a preferred phasing relationship relative to injection events 64, but instead are generated as needed when rail pressure 62 reaches a low pressure threshold and additional fuel pressure is needed for the next injection event 64. Thus, actual pumping events 70 occur during potential pumping events 66 at certain times and during potential pumping events 68 at other times. The fact that all actual pumping events 70 provide 100% fuel delivery results in an increase in the overall efficiency of pump 14.

Figure 19:
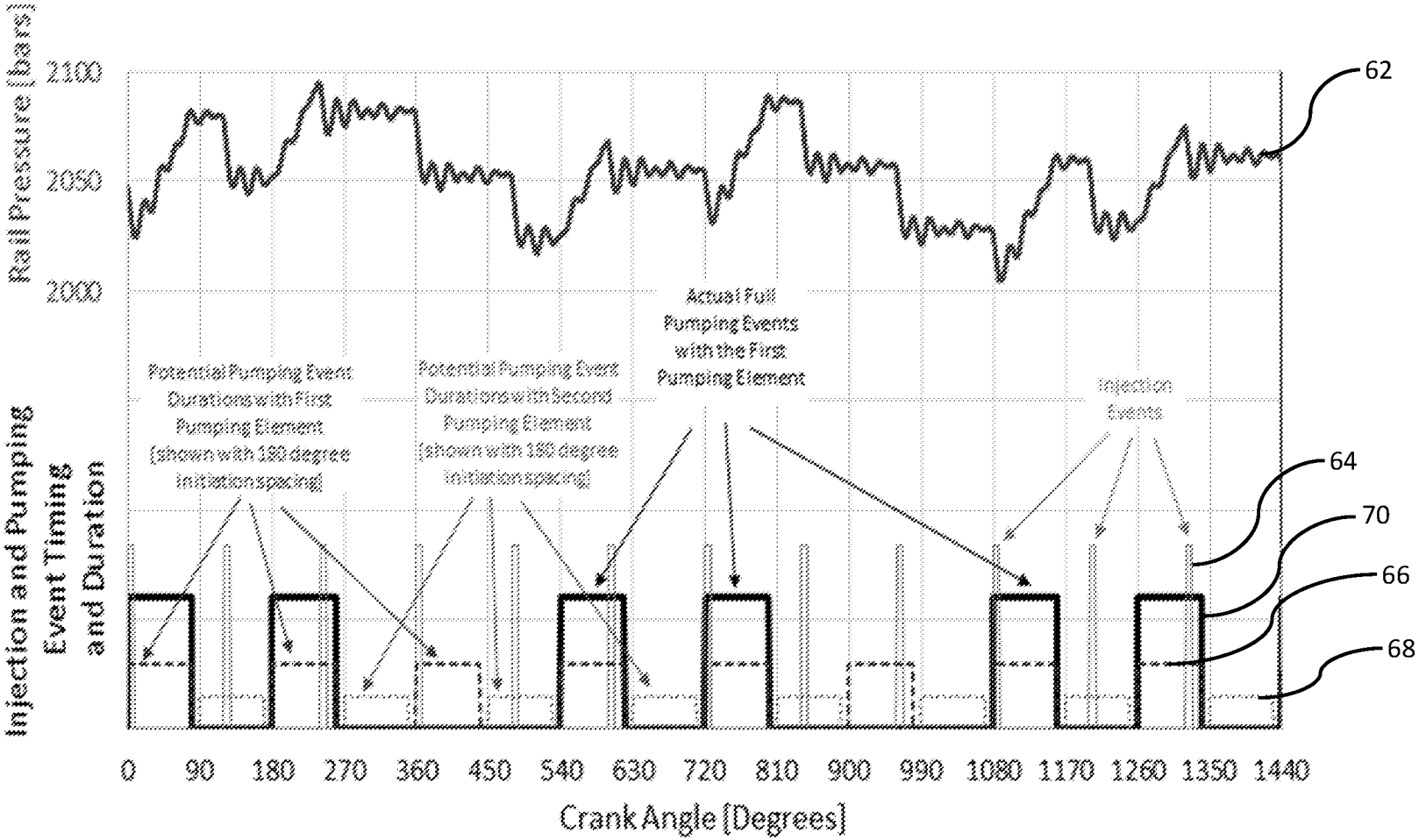

Referring now to FIG. 19, the operation of a 1.5 pumping to injection ratio system is depicted using an alternative control methodology according to the present disclosure. As shown, the control methodology employs binary pumping and maintains rail pressure 62 using only one pumping element 30 (i.e., the pumping element 30 corresponding to potential pumping events 66). This control methodology may be employed when the pumping element 30 corresponding to potential pumping events 68 is malfunctioning or otherwise not desirable for use. While the binary pumping with one pumping element 30 depicted in FIG. 19 results in improved efficiency relative to the control methodology underlying FIG. 17, rail pressure 62 in FIG. 19 shows more variation than rail pressure 62 in FIG. 18.

Figure 20:
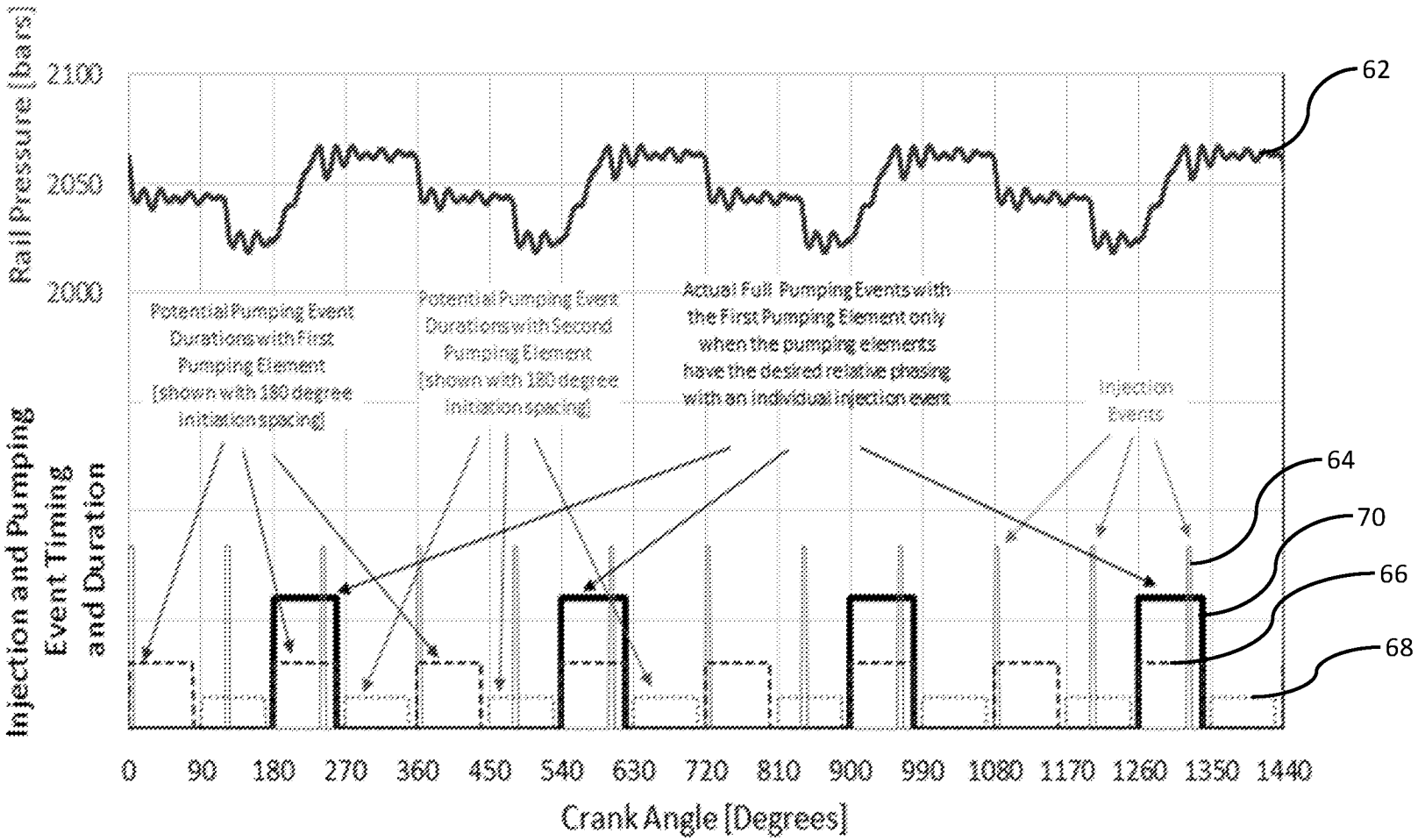

The control methodology underlying FIG. 20 employs binary, phased pumping in a 1.5 pumping to injection ratio system where use of one pumping element 30 is sufficient to maintain rail pressure 62 within a desired pressure range. As shown, a 100% delivery actual pumping event 70 every 360 degrees is sufficient to satisfy the demand of the intervening injection events 64. The binary pumping provides increased efficiency, and the phased pumping provides reduced audible noise, vibration and harshness. Also, as can be seen in the figure, a relatively stable rail pressure 62 is maintained.

Figure 21:
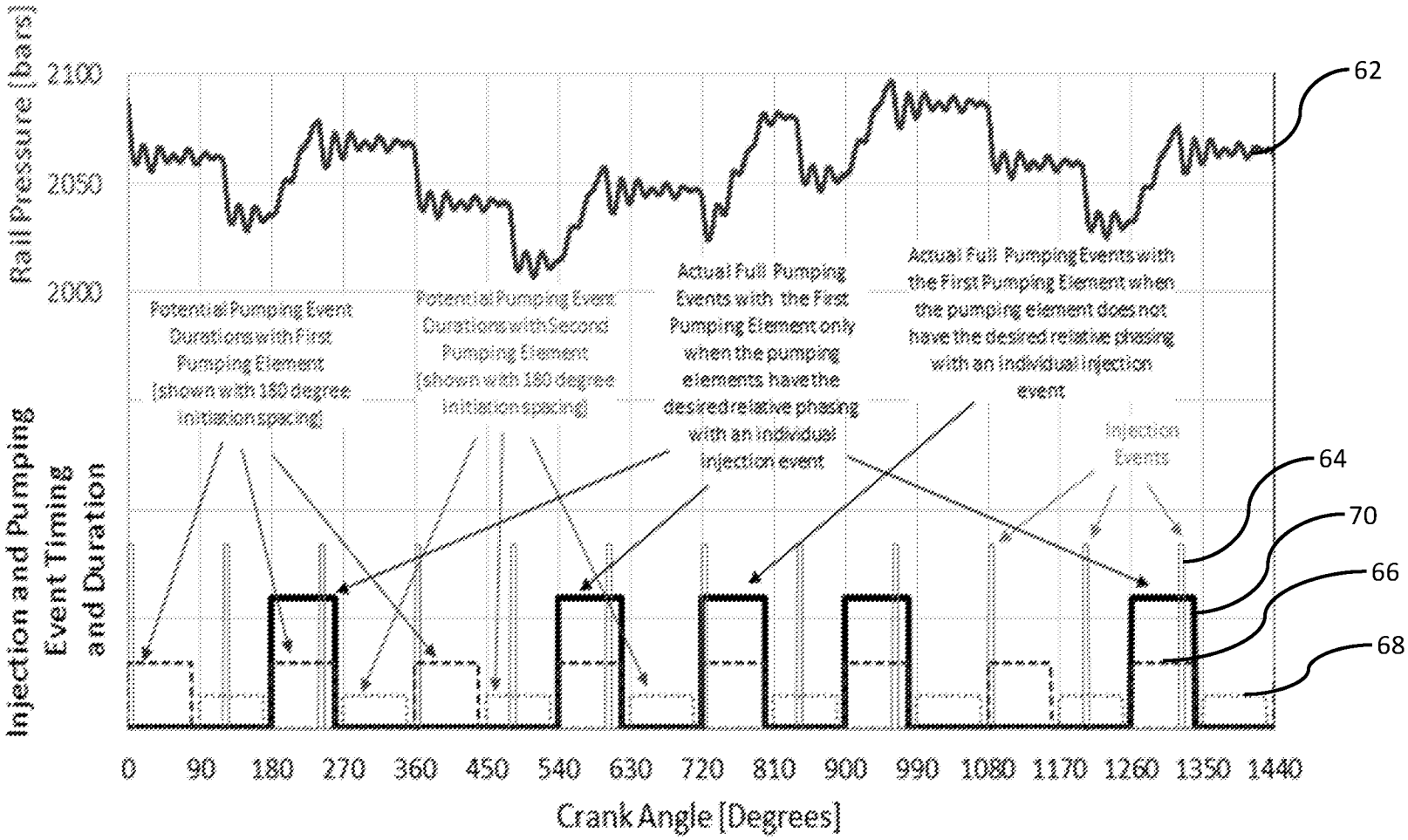

The control methodology underlying FIG. 21 is similar to that of FIG. 20, but rail pressure 62 cannot be maintained in the FIG. 21 system configuration using only the desired phased pumping of FIG. 20. In other words, 100% delivery actual pumping events 70 every 360 degrees during potential pumping events 66 result in a gradual reduction in rail pressure (compare rail pressure 62 immediately following actual pumping event 70 at 180 degrees to rail pressure 62 immediately following actual pumping event 70 at 540 degrees). As such, periodically an actual pumping event 70 that is not at a preferred phasing relationship relative to injection events 64 (such as actual pumping event 70 at 720 degrees) is needed to maintain rail pressure 62 within a desired pressure range. In this manner, the control methodology underlying FIG. 21 implements a high priority for generating 100% delivery actual pumping events 70 at the desired phasing relative to injection events 64 (i.e., every 360 degrees) and a lower priority for generating 100% delivery actual pumping events 70 using the same pumping element 30 but not at the desired phasing as needed to maintain rail pressure 62 within a desired pressure range.

Figure 22:
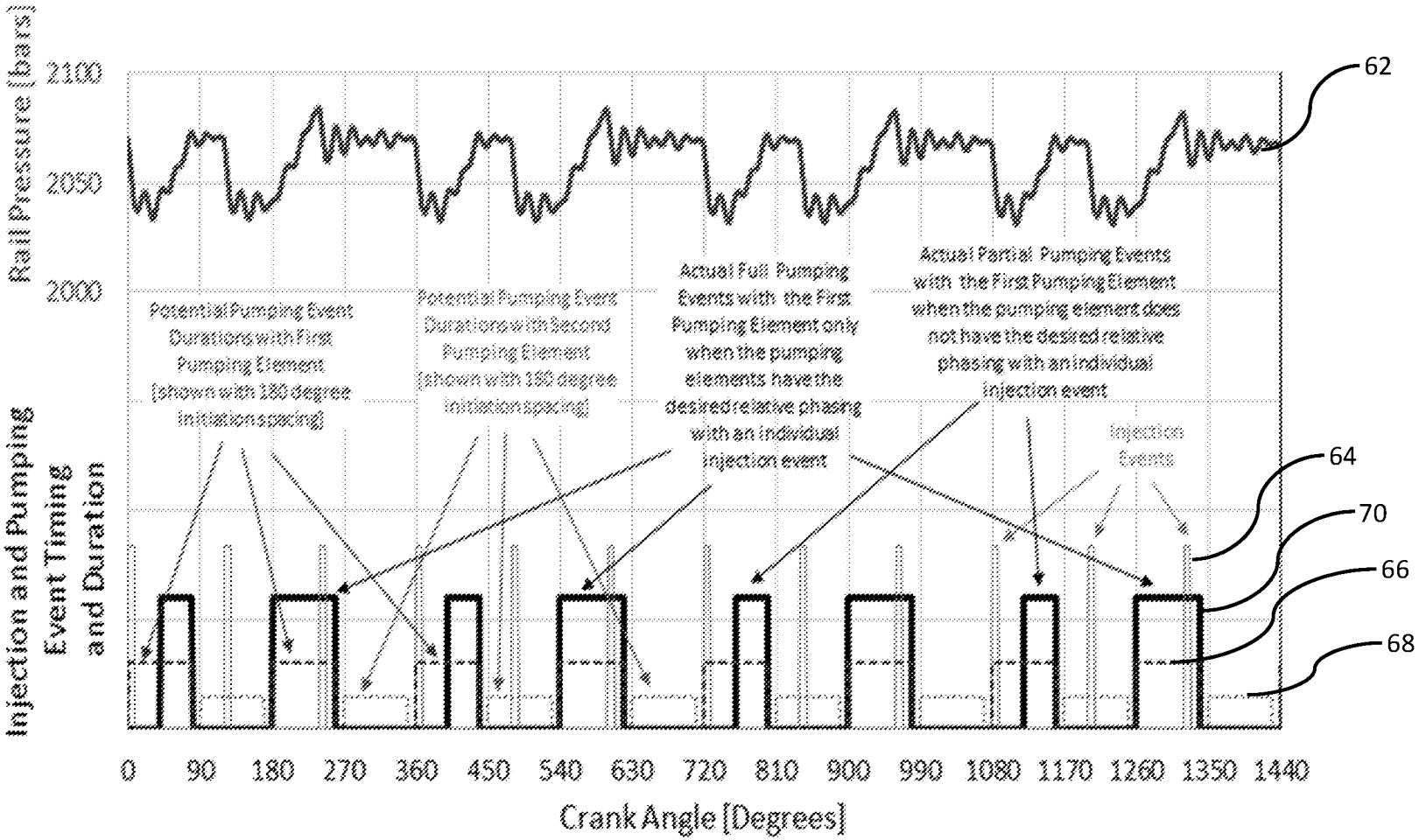

The results of another variation of a control methodology for a 1.5 pumping to injection ratio system are depicted in FIG. 22. This control methodology is similar to that of FIG. 21 in that it implements a high priority for generating 100% delivery actual pumping events 70 during potential pumping events 66 every 360 degrees and a lower priority for generating actual pumping events 70 using the same pumping element 30 but not at the desired phasing as needed to maintain rail pressure 62 within a desired pressure range. Rather than periodically generating a 100% delivery actual pumping event 70 that is not at a preferred phasing relationship relative to injection events 64 such as actual pumping event 70 at 720 degrees in FIG. 21 to maintain rail pressure 62, the control methodology of FIG. 22 generates a partial delivery actual pumping event 70 during every pumping event 66 that is at a preferred phasing relationship relative to injection events 64. This methodology results in somewhat reduced efficiency compared to FIG. 21 because all actual pumping events 70 are not 100% fuel delivery, but it provides a more stable rail pressure 62.

Figure 23:
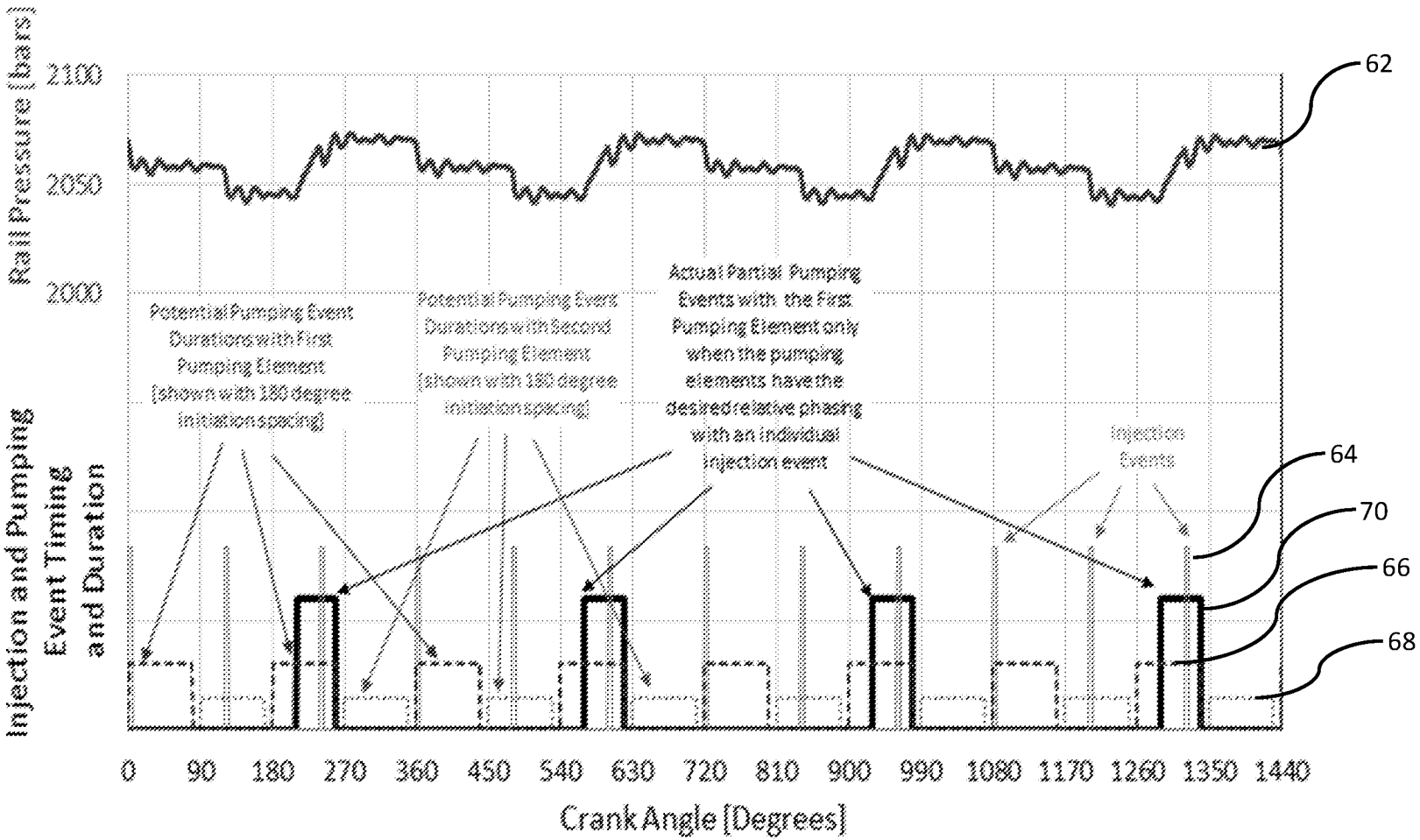

The control methodology of FIG. 23 is very similar to that of FIG. 20. The only difference is that partial delivery (rather than 100% delivery) actual pumping events 70 are generated by the methodology of FIG. 23. In the 1.5× pumping to injection ratio system of FIG. 23, rail pressure 62 may be maintained within a desired pressure range using less than 100% delivery actual pumping events 70 during potential pumping events 66 every 360 degrees. Comparing the two figures shows that rail pressure 62 resulting from the control methodology and system of FIG. 23 is more stable than rail pressure 62 in FIG. 20.

Figure 24:
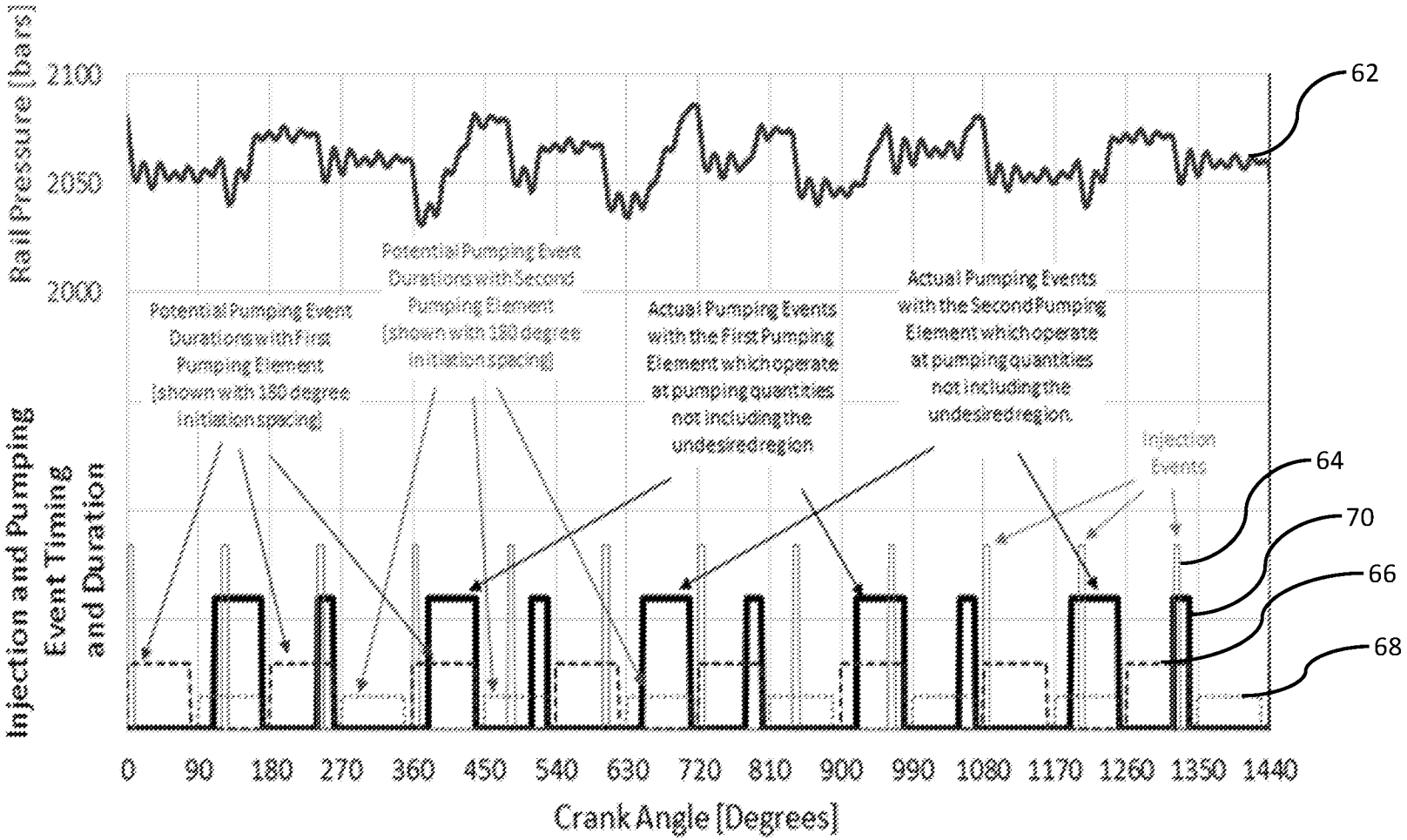

Like the control methodology of FIG. 10, the control methodology of FIG. 24 is designed for situations wherein a particular fuel delivery percentage per pumping event is considered undesirable, but the methodology of FIG. 24 is controlling a 1.5× pumping to injection ratio system rather than a 2× pumping to injection ratio system. In this methodology, actual pumping events 70 are not at a preferred phasing relationship relative to injection events 64 and are generated using both potential pumping events 66, 68. The actual pumping events 70 alternate between delivering a quantity of fuel that is above the undesirable delivery percentage and an amount of fuel that is below the undesirable delivery percentage.

Figure 25:
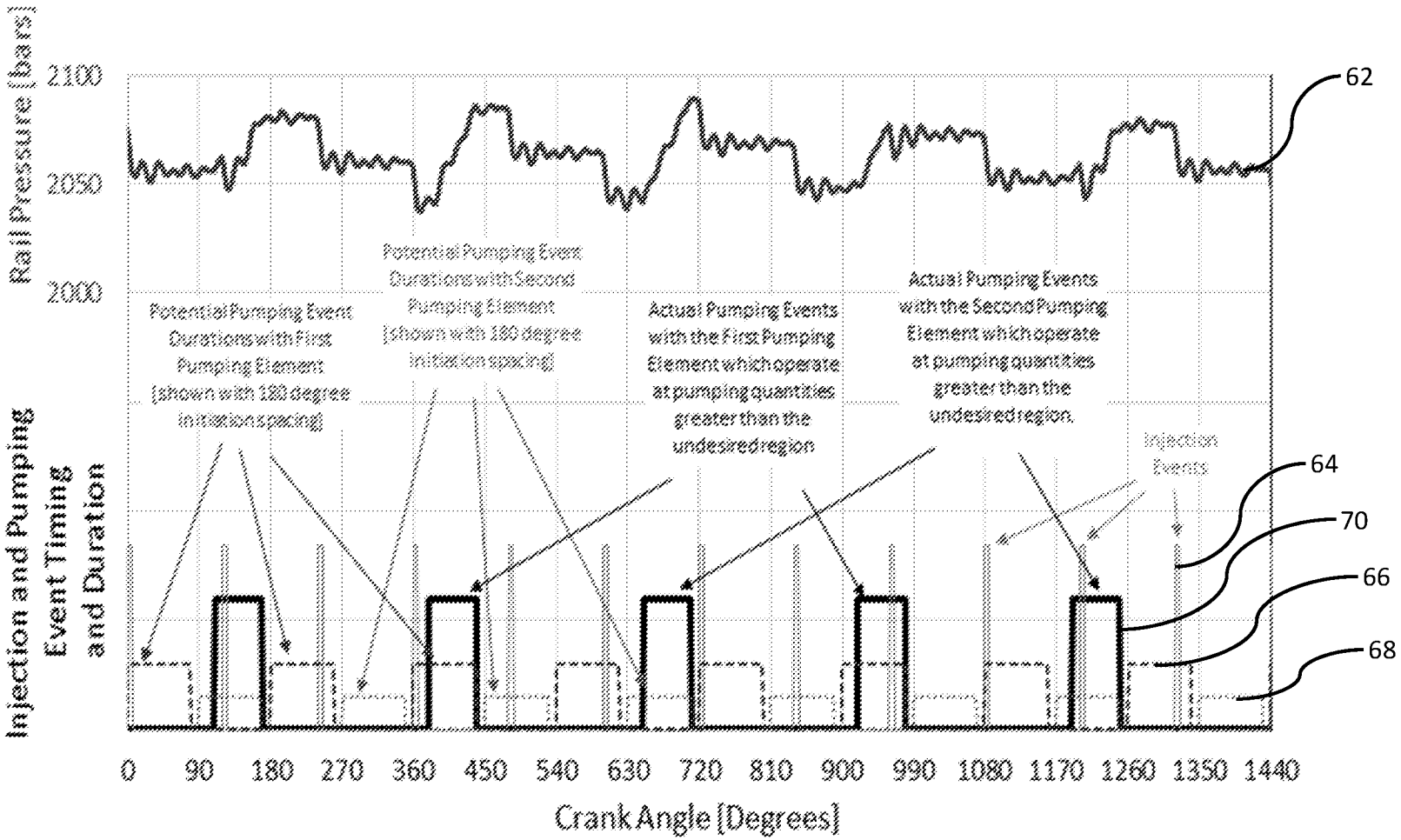

In FIG. 25, the control methodology also avoids actual pumping events 70 that deliver an undesirable fuel percentage. Here, however, all actual pumping events 70 deliver a fuel quantity that is greater than the undesired fuel quantity and are generated whenever necessary (i.e., during either potential pumping event 66, 68) to maintain rail pressure 62 in view of upcoming injection events 64.

Figure 26:
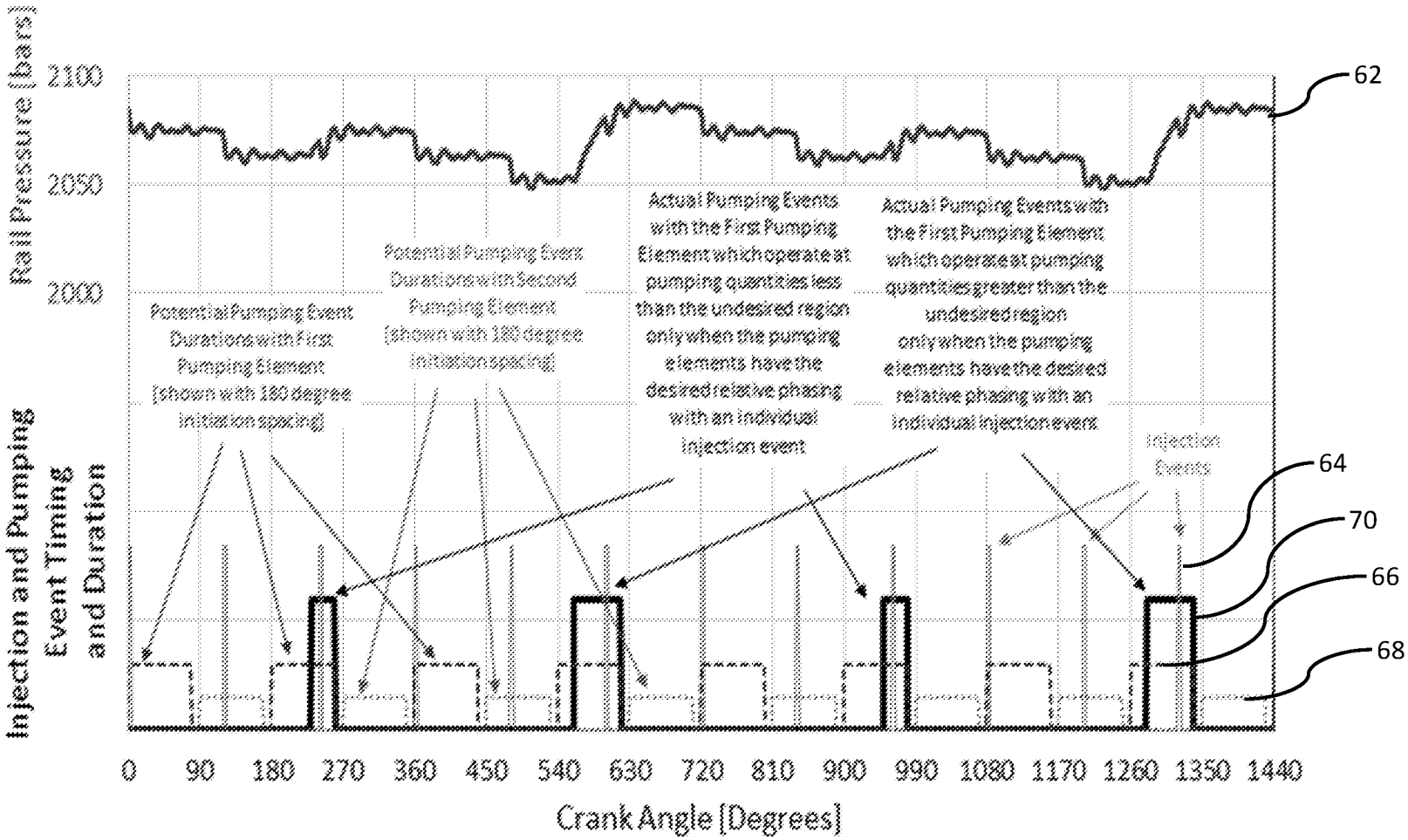

The control methodology underlying FIG. 26 generates actual pumping events 70 to avoid an undesirable fuel percentage for a 1.5 pumping to injection ratio system with actual pumping events 70 at a preferred phasing relationship relative to injection events 64 and all being delivered by the pumping element 30 corresponding to potential pumping events 66. The actual pumping events 70 alternate between fuel delivery in an amount less than the undesirable percentage and fuel delivery in an amount greater than the undesirable percentage.

Figure 27:
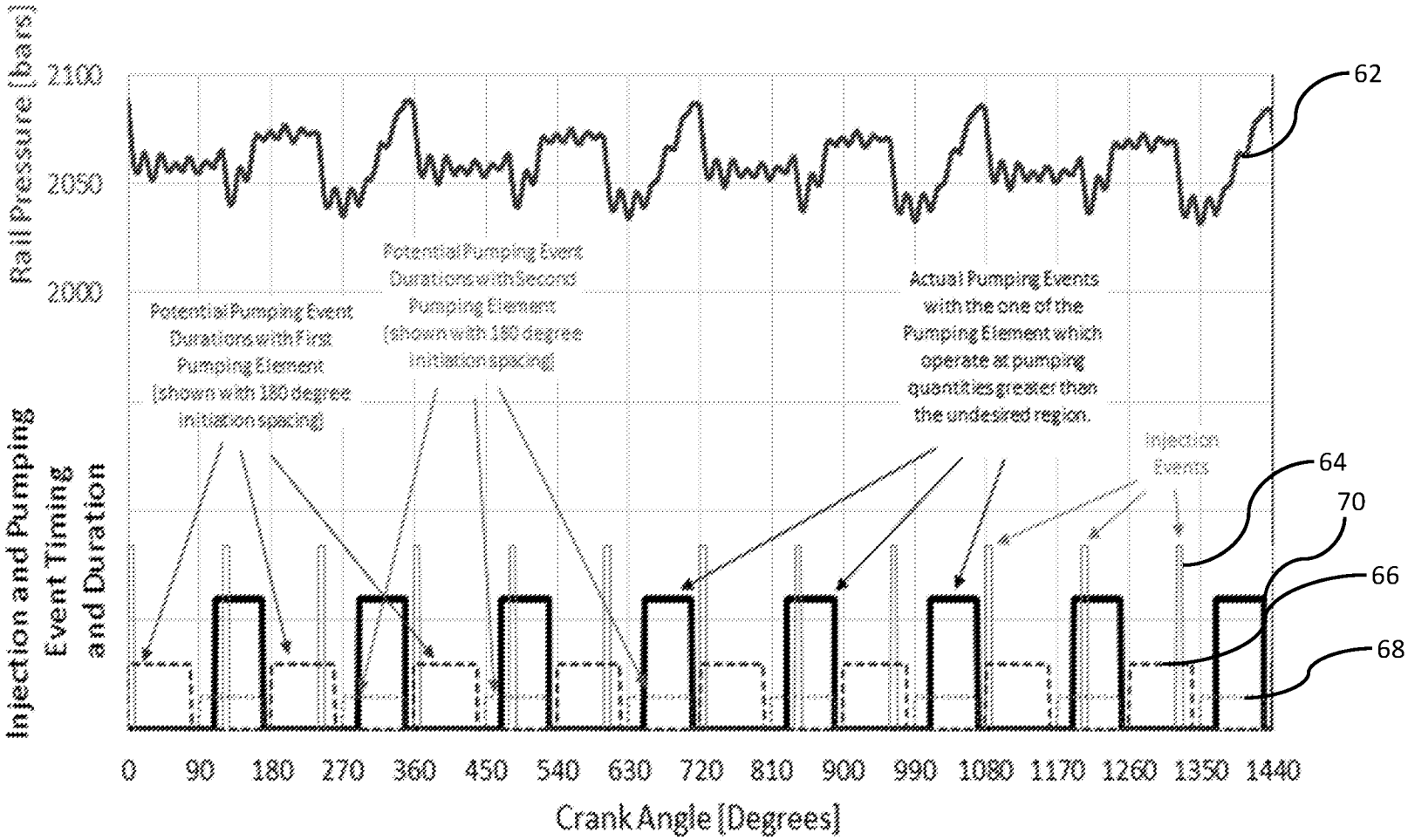

Referring now to FIG. 27, the results of another control methodology that avoids actual pumping events 70 that deliver an undesirable fuel percentage are shown. In this methodology, all of actual pumping events 70 deliver an amount of fuel that is greater than the undesirable fuel percentage, and all occur during potential pumping events 68.

Figure 28:
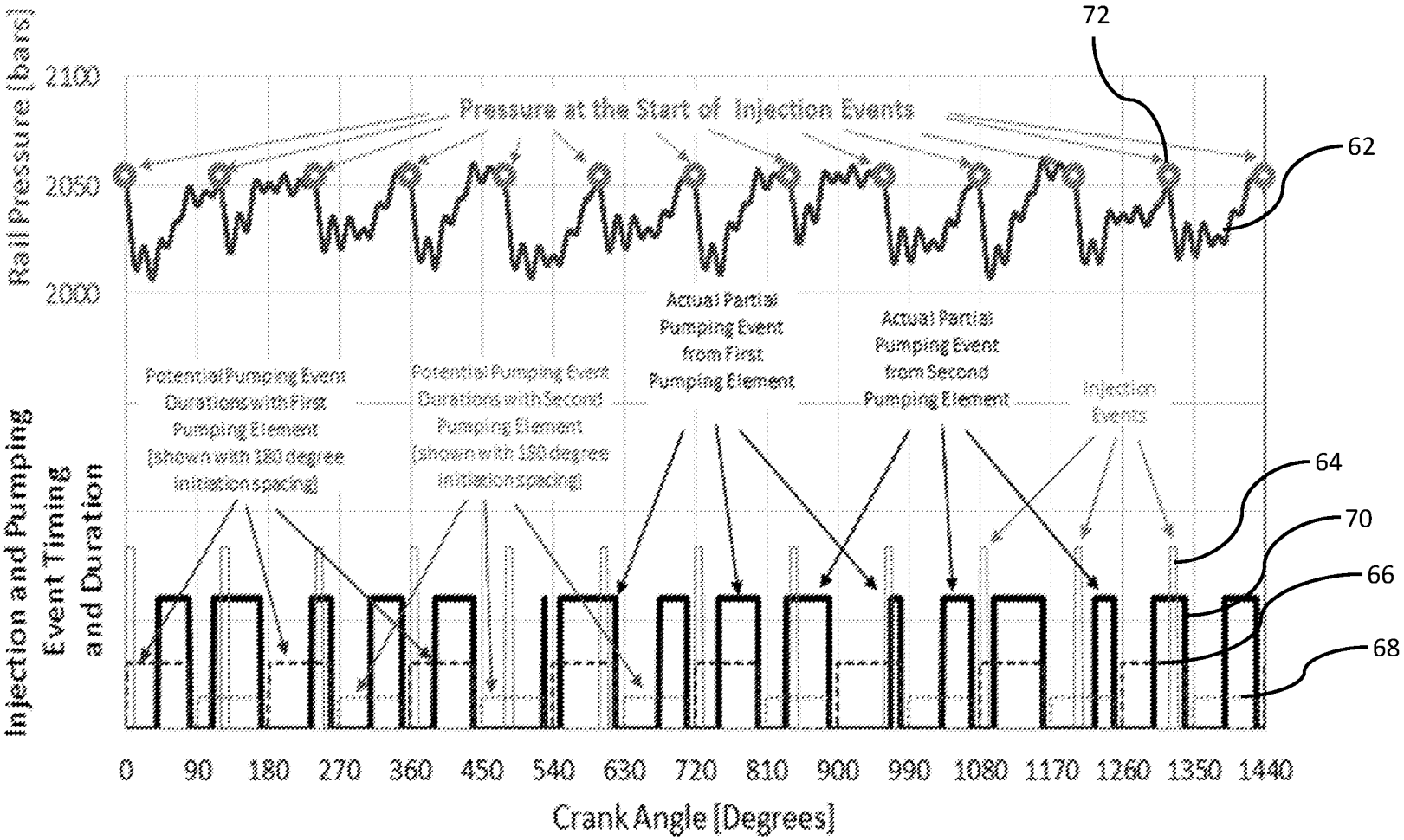
Figure 29:
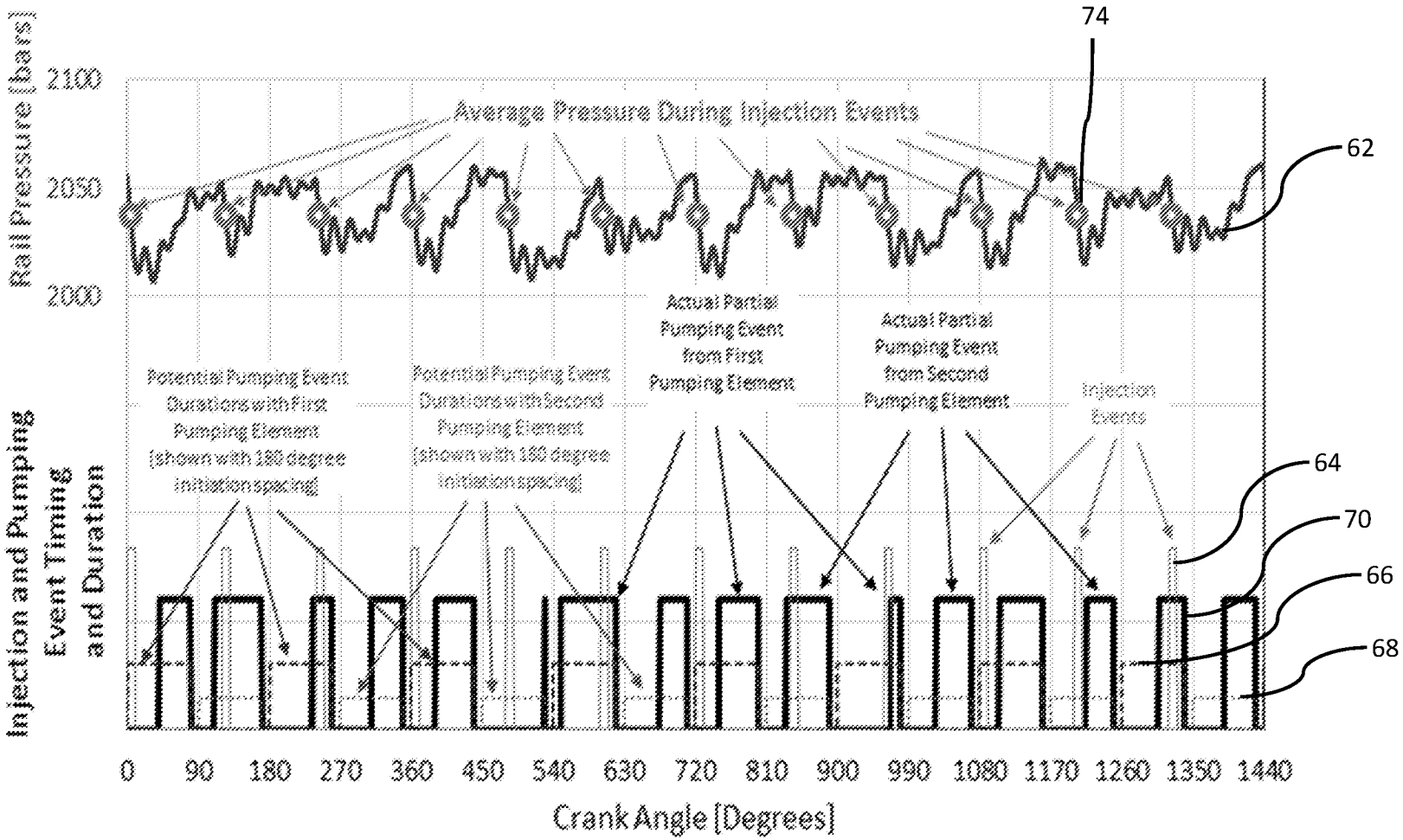

FIG. 28 depicts the results of a first example of a control methodology configured to implement pumping to minimize injection pressure variations (not binary pumping, phased pumping or gentle pumping). A consistent injection pressure can be useful in improving fuel economy and reducing undesirable emissions. As shown, using this control methodology, an actual pumping event 70 is generated as necessary during each of potential pumping events 66, 68 regardless of phasing relative to injection events 64 to achieve a substantially constant rail pressure 62 at the start of each injection event 64 (indicated by circles 72). FIG. 29 depicts the results of a similar control methodology that controls rail pressure 62 to be substantially constant during the middle of each injection event 64 (indicated by circles 74).

Figure 30:
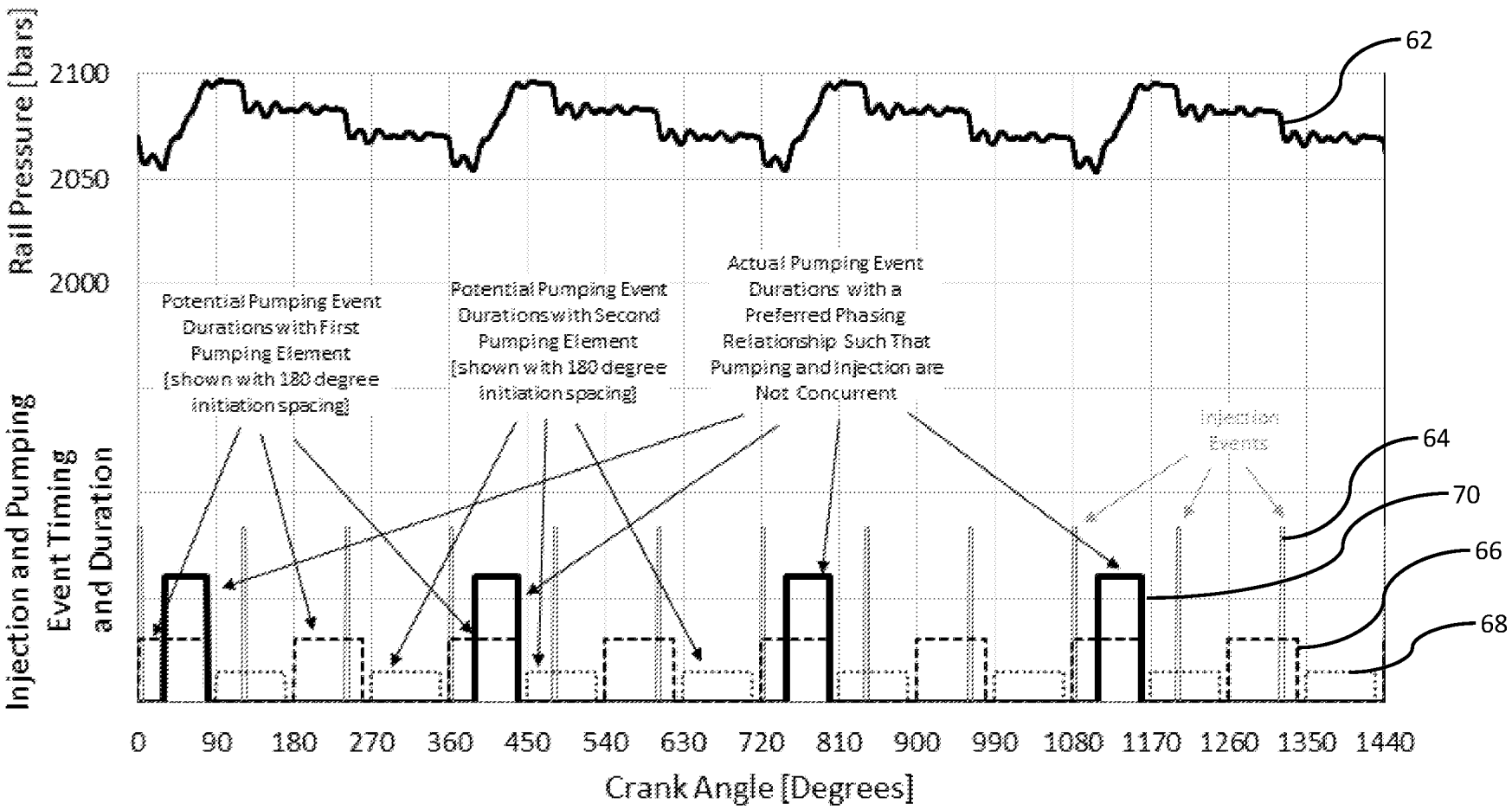
Figure 31:
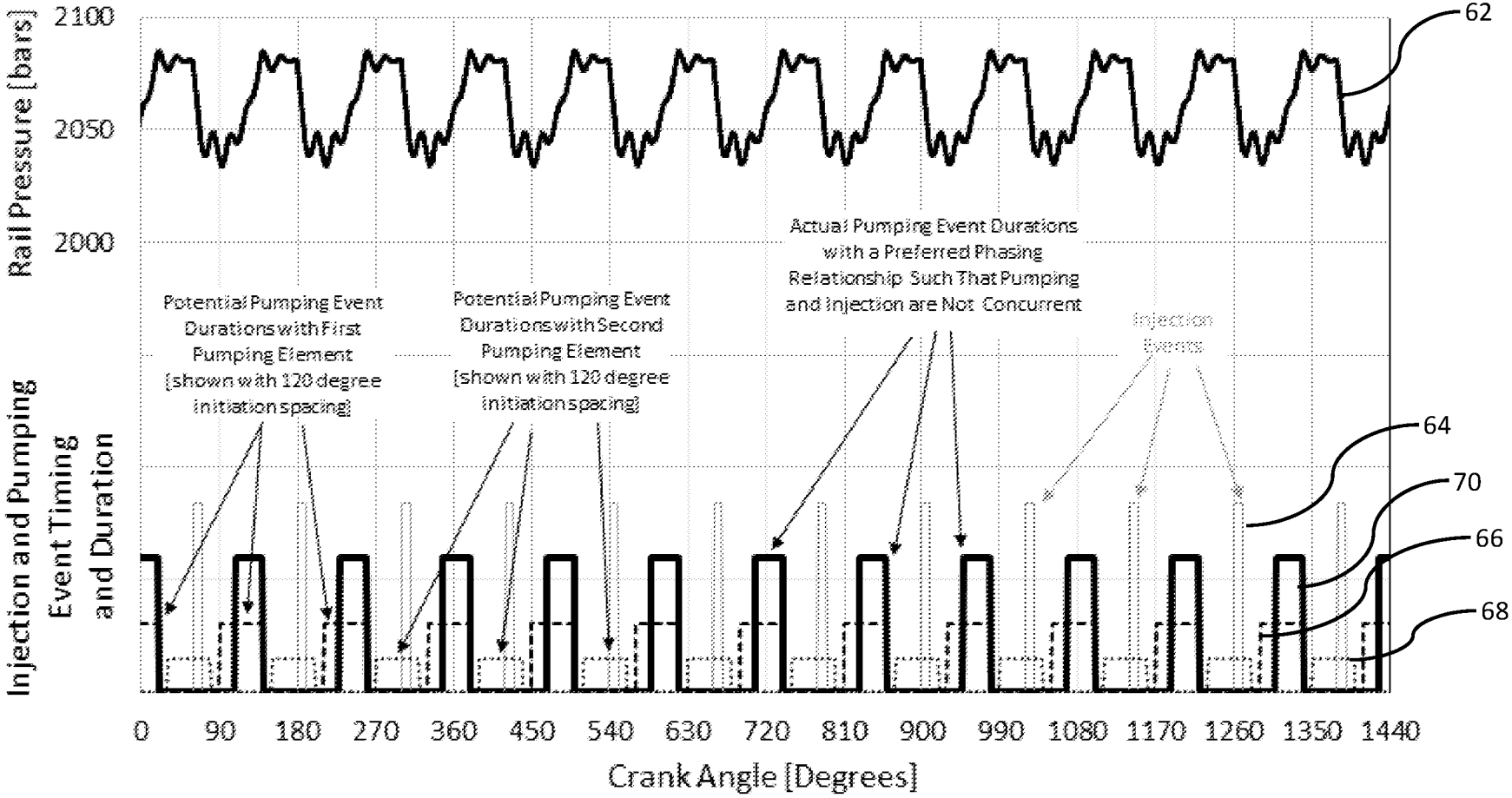
FIG. 31 is a graph of results of a control methodology according to the present disclosure used with the pumping configuration of FIG. 3.

FIG. 30 depicts the results of a control methodology configured to implement pumping according to a preferred phasing relationship in which none of injection events 64 are concurrent with actual pumping events 70. As shown, partial pumping events 70 are generated as necessary during every other potential pumping event 66 to maintain rail pressure 62 to within a desired range. FIG. 30 shows this control methodology applied to a 1.5 pumping to injection ratio system, which FIG. 31 shows the same methodology applied to a 2× pumping to injection ratio system.

It should be understood that FIGS. 3-31 depict operation of control methodologies during steady-state engine operation, but the methodologies may also be employed during transient engine conditions. It should further be understood that multiple control methodologies may be employed as desired in response to changes in engine operating requirements or other influences. As mentioned above, in control methodologies that implement some combination of binary pumping, phased pumping, gentle pumping or pumping to minimize injection pressure variations, the relative importance of the goals corresponding to these modes of operation (e.g., efficiency, noise reduction, pump reliability and injection pressure control) may be weighted to achieve a customized set of operational goals.

It should be understood that, the connecting lines shown in the various figures contained herein are intended to represent exemplary functional relationships and/or physical couplings between the various elements. It should be noted that many alternative or additional functional relationships or physical connections may be present in a practical system. However, the benefits, advantages, solutions to problems, and any elements that may cause any benefit, advantage, or solution to occur or become more pronounced are not to be construed as critical, required, or essential features or elements. The scope is accordingly to be limited by nothing other than the appended claims, in which reference to an element in the singular is not intended to mean "one and only one" unless explicitly so stated, but rather "one or more." Moreover, where a phrase similar to "at least one of A, B, or C" is used in the claims, it is intended that the phrase be interpreted to mean that A alone may be present in an embodiment, B alone may be present in an embodiment, C alone may be present in an embodiment, or that any combination of the elements A, B or C may be present in a single embodiment; for example, A and B, A and C, B and C, or A and B and C.

In the detailed description herein, references to "one embodiment," "an embodiment," "an example embodiment," etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art with the benefit of the present disclosure to affect such feature, structure, or characteristic in connection with other embodiments whether or not explicitly described. After reading the description, it will be apparent to one skilled in the relevant art(s) how to implement the disclosure in alternative embodiments.

Furthermore, no element, component, or method step in the present disclosure is intended to be dedicated to the public regardless of whether the element, component, or method step is explicitly recited in the claims. No claim element herein is to be construed under the provisions of 35 U.S.C. 112(f), unless the element is expressly recited using the phrase "means for." As used herein, the terms "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus Various modifications and additions can be made to the exemplary embodiments discussed without departing from the scope of the present disclosure. For example, while the embodiments described above refer to particular features, the scope of this disclosure also includes embodiments having different combinations of features and embodiments that do not include all of the described features. Accordingly, the scope of the present disclosure is intended to embrace all such alternatives, modifications, and variations as fall within the scope of the claims, together with all equivalents thereof.

We claim:

1. A method of controlling a pump having a plurality of pumping elements including a first pumping element and a second pumping element configured to provide pressurized fuel to a common rail accumulator coupled to a plurality of fuel injectors configured to inject fuel into a corresponding plurality of cylinders of an engine, comprising:

receiving at least one rail pressure value indicating a current fuel pressure in the accumulator; and responding to a received at least one rail pressure value by controlling operation of the plurality of pumping elements during each potential pumping event of the plurality of pumping elements to generate actual pumping events during at least some of the potential pumping events to cause the at least one rail pressure value to remain within a desired range or achieve a desired pressure value;

wherein each of the potential pumping events of the first pumping element is concurrent with an injection event of the plurality of fuel injectors and each of the potential pumping events of the second pumping element is not concurrent with an injection event of the plurality of fuel injectors.

2. The method of claim 1, wherein the first pumping element and the second pumping element are components of a single pump.

3. The method of claim 2, wherein the first and second pumping elements are each configured to have one of a 1×, 1.5× or 2× ratio of potential pumping events to injection events by the plurality of fuel injectors.

4. The method of claim 2, wherein responding to the received at least one rail pressure value by controlling operation of the plurality of pumping elements comprises generating actual pumping events of either 100% fuel delivery or 0% fuel delivery during each of the potential pumping events to increase the overall efficiency of the pump.

5. The method of claim 2, wherein responding to the received at least one rail pressure value by controlling operation of the plurality of pumping elements comprises generating actual pumping events of either 100% fuel delivery or 0% fuel delivery during each of the potential pumping events of the first pumping element and generating actual pumping events of 0% fuel delivery during all of the potential pumping events of the second pumping element, thereby decreasing audible noise generated by the pump or engine.

6. The method of claim 2, wherein responding to the received at least one rail pressure value by controlling operation of the plurality of pumping elements comprises generating actual pumping events of greater than 0% but less than 100% fuel delivery during each of the potential pumping events of the first pumping element and generating actual pumping events of 0% fuel delivery during each of the potential pumping events of the second pumping element, thereby decreasing audible noise generated by the pump or engine.

7. The method of claim 2, wherein responding to the received at least one rail pressure value by controlling operation of the plurality of pumping elements comprises generating actual pumping events of 100% fuel delivery during each of the potential pumping events of the first pumping element and generating actual pumping events of either 100% fuel delivery or 0% fuel delivery during the potential pumping events of the second pumping element, thereby increasing the overall efficiency of the pump and decreasing audible noise of the pump or engine.

8. The method of claim 2, wherein responding to the received at least one rail pressure value by controlling operation of the plurality of pumping elements comprises generating actual pumping events of 100% fuel delivery during each of the potential pumping events of the first pumping element and generating actual pumping events of greater than 0% but less than 100% fuel delivery during each of the potential pumping events of the second pumping element.

9. The method of claim 2, wherein responding to the received at least one rail pressure value by controlling operation of the plurality of pumping elements comprises generating actual pumping events to deliver an amount of fuel that is greater than an undesirable fuel delivery percentage during half of the potential pumping events of the first pumping element, generating actual pumping events to deliver an amount of fuel that is less than the undesirable fuel delivery percentage during another half of the potential pumping events of the first pumping element and generating actual pumping events of 0% fuel delivery during each of the potential pumping events of the second pumping element, thereby improving the reliability of the pump.

10. The method of claim 2, wherein responding to the received at least one rail pressure value by controlling operation of the plurality of pumping elements comprises generating actual pumping events to deliver either 0% fuel delivery or an amount of fuel that is greater than an undesirable fuel delivery percentage during each of the potential pumping events of the first pumping element and during each of the potential pumping events of the second pumping element.

11. The method of claim 2, wherein responding to the received at least one rail pressure value by controlling operation of the plurality of pumping elements comprises generating actual pumping events to deliver either 0% fuel delivery or an amount of fuel that is greater than an undesirable fuel delivery percentage during each of the potential pumping events of the first pumping element and generating actual pumping events of 0% fuel delivery during each of the potential pumping events of the second pumping element.

12. The method of claim 2, wherein responding to the received at least one rail pressure value by controlling operation of the plurality of pumping elements comprises generating actual pumping events of 100% fuel delivery during each of the potential pumping events of one of the first and second pumping elements and generating actual pumping events of greater than 0% but less than 100% fuel delivery during each of the potential pumping events of another of the first and second pumping elements.

13. The method of claim 2, wherein responding to the received at least one rail pressure value by controlling operation of the plurality of pumping elements comprises generating actual pumping events to deliver an amount of fuel that is greater than an undesirable fuel delivery percentage during each of the potential pumping events of one of the first and second pumping elements and generating actual pumping events to deliver an amount of fuel that is less than the undesirable fuel delivery percentage during each of the potential pumping events of another of the first and second pumping elements, thereby improving the reliability of the pump.

14. The method of claim 2, wherein responding to the received at least one rail pressure value by controlling operation of the plurality of pumping elements comprises generating actual pumping events of either 100% fuel delivery or 0% fuel delivery during each of the potential pumping events of one of the first and second pumping elements and generating actual pumping events of 0% fuel delivery during each of the potential pumping events of another of the first and second pumping elements.

15. The method of claim 14, wherein the actual pumping events of 100% fuel delivery are during potential pumping events of the first pumping element, thereby decreasing audible noise of the pump or engine.

16. The method of claim 2, wherein responding to the received at least one rail pressure value by controlling operation of the plurality of pumping elements comprises generating actual pumping events of 100% fuel delivery during each of the potential pumping events of the first pumping element, generating actual pumping events of greater than 0% but less than 100% fuel delivery during each of the potential pumping events of the second pumping element, and generating actual pumping events of 0% fuel delivery during each potential pumping event of another pumping element.

17. The method of claim 2, wherein responding to the received at least one rail pressure value by controlling operation of the plurality of pumping elements comprises generating actual pumping events to deliver an amount of fuel that is either less than or greater than an undesirable fuel delivery percentage during each of the potential pumping events of the first pumping element and generating actual pumping events of 0% fuel delivery during each of the potential pumping events of the second pumping element and during each potential pumping event of another pumping element.

18. The method of claim 2, wherein responding to the received at least one rail pressure value by controlling operation of the plurality of pumping elements comprises generating actual pumping events during each of the potential pumping events to deliver an amount of fuel to the accumulator to cause rail pressure to be substantially the same at a start of each injection event.

19. The method of claim 2, wherein responding to the received at least one rail pressure value by controlling operation of the plurality of pumping elements comprises generating actual pumping events during each of the potential pumping events to deliver an amount of fuel to the accumulator to cause rail pressure to be substantially the same during each injection event.

20. A method of controlling a fuel pump having a plurality of pumping elements, comprising:

determining at least one of a desired rail pressure range or a desired rail pressure value;

determining a quantity of fuel to deliver during each potential pumping event corresponding to the plurality of pumping elements to maintain the rail pressure within the desired rail pressure range or near the desired rail pressure value and to increase pump efficiency, decrease audible noise generated by the pump, or improve pump reliability; and generating actual pumping events to deliver the determined quantity of fuel during each potential pumping event;

wherein generating actual pumping events comprises one of generating actual pumping events of either 100% fuel delivery or 0% fuel delivery to improve pump reliability, generating actual pumping events during potential pumping events that are at preferred phasing relative to injection events to decrease pump audible noise, or generating actual pumping events to deliver an amount of fuel that is greater than or less than an undesirable fuel delivery percentage to improve pump reliability.

21. A fueling system, comprising:

a fuel pump comprising a plurality of pumping elements;

an accumulator coupled to the fuel pump;

a pressure sensor coupled to the accumulator, the pressure sensor configured to output a rail pressure value;

a plurality of fuel injectors coupled to the accumulator to receive pressurized fuel for delivery to an engine during injection events; and a controller coupled to the fuel pump, the pressure sensor and the plurality of fuel injectors, the controller being configured to determine a desired range of rail pressure values, determine a quantity of fuel to deliver during each potential pumping event corresponding to the plurality of pumping elements to maintain the rail pressure value within the desired range and to increase fuel pump efficiency, decrease audible noise generated by the fuel pump, or improve fuel pump reliability, and generate actual pumping events to deliver the determined quantity of fuel during each potential pumping event;

wherein the controller is configured to generate actual pumping events such that the actual pumping events are one of actual pumping events of either 100% fuel delivery or 0% fuel delivery to improve pump reliability, actual pumping events during potential pumping events that are at preferred phasing relative to injection events to decrease pump audible noise, or actual pumping events to deliver an amount of fuel that is greater than or less than an undesirable fuel delivery percentage to improve pump reliability.

* * * * *